US007454330B1

(12) United States Patent
Nishiguchi et al.

(10) Patent No.: US 7,454,330 B1
(45) Date of Patent: Nov. 18, 2008

(54) METHOD AND APPARATUS FOR SPEECH ENCODING AND DECODING BY SINUSOIDAL ANALYSIS AND WAVEFORM ENCODING WITH PHASE REPRODUCIBILITY

(75) Inventors: Masayuki Nishiguchi, Tokyo (JP); Kazuyuki Iijima, Tokyo (JP); Jun Matsumoto, Tokyo (JP); Shiro Omori, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 08/736,546

(22) Filed: Oct. 24, 1996

(30) Foreign Application Priority Data

Oct. 26, 1995 (JP) ..... 7-302129

(51) Int. Cl.
*G10L 19/14* (2006.01)

(52) U.S. Cl. ..... 704/224; 704/225; 704/226

(58) Field of Classification Search ..... 704/219–229
See application file for complete search history.

(56) References Cited

U.S. PATENT DOCUMENTS

| | | | | | |
|---|---|---|---|---|---|
| 4,912,764 | A | * | 3/1990 | Hartwell et al. | 381/38 |
| 5,067,158 | A | * | 11/1991 | Arjmand | 381/51 |
| 5,127,053 | A | * | 6/1992 | Koch | 381/31 |
| 5,138,661 | A | * | 8/1992 | Zinser et al. | 381/35 |
| 5,228,086 | A | * | 7/1993 | Morii | 381/36 |
| 5,323,486 | A | * | 6/1994 | Taniguchi et al. | 395/2.31 |
| 5,473,727 | A | * | 12/1995 | Nishiguchi et al. | 395/2.31 |
| 5,487,086 | A | * | 1/1996 | Bhaskar | 375/243 |
| 5,537,509 | A | * | 7/1996 | Swaminathan et al. | 395/2.37 |
| 5,596,675 | A | * | 1/1997 | Ishii et al. | 395/2.2 |
| 5,623,575 | A | * | 4/1997 | Fette et al. | 395/2.74 |

(Continued)

FOREIGN PATENT DOCUMENTS

EP 0260053 3/1988

OTHER PUBLICATIONS

Ozawa, "4kb/s Improved CELP Coder with efficient Vector Quantization", ICASSP 1991.*

(Continued)

*Primary Examiner*—David R. Hudspeth
*Assistant Examiner*—Michael N. Opsasnick
(74) *Attorney, Agent, or Firm*—Jay H. Maioli

(57) ABSTRACT

A speech encoding method and apparatus in which an input speech signal is divided in terms of blocks or frames as encoding units and encoded in terms of the encoding units, whereby explosive and fricative consonants can be impeccably reproduced, while there is an attenuation of the occurrence of foreign sounds being generated at a transient portion between voiced (V) and unvoiced (UV) portions, so that the speech with high clarity devoid of "stuffed" feeling may be produced. The encoding apparatus includes a first encoding unit for finding residuals of linear predictive coding (LPC) of an input speech signal for performing harmonic coding and a second encoding unit for encoding the input speech signal by waveform coding. The first encoding unit and the second encoding unit are used for encoding a voiced (V) portion and an unvoiced (UV) portion of the input signal, respectively. Code excited linear prediction (CELP) encoding employing vector quantization by a closed loop search of an optimum vector using an analysis-by-synthesis method is used for the second encoding unit. A corresponding decoding method and apparatus is also provided.

28 Claims, 19 Drawing Sheets

U.S. PATENT DOCUMENTS 5,752,222 A * 5/1998 Nishiguchi et al. ..... 704/201

OTHER PUBLICATIONS

Proceedings of the IEEE, vol. 8, No. 5, May 1996, pp. 65-84 (Tanaka et al.).

European Transactions on Telecommunications and Related Technologies, vol. 6, No. 6, Nov.-Dec. 1995, pp. 685-693 (Mumolo et al.).

Proceeding of the IEEE, May 1995, pp. 508-511 (Kleijn et al.).

Proceeding of the IEEE, vol. 82, No. 10, Oct. 1994, pp. 1541-1582 (Spanias).

* cited by examiner

METHOD AND APPARATUS FOR SPEECH ENCODING AND DECODING BY SINUSOIDAL ANALYSIS AND WAVEFORM ENCODING WITH PHASE REPRODUCIBILITY

BACKGROUND OF THE INVENTION

1. Field of the Invention

This invention relates to a speech encoding method in which an input speech signal is divided in terms of blocks or frames as encoding units and encoded in terms of the encoding units, a decoding method for decoding the encoded signal, and a speech encoding/decoding method.

2. Description of the Related Art

There have conventionally been known a variety of encoding methods for encoding an audio signal (inclusive of speech and acoustic signals) for signal compression by exploiting statistic properties of the signals in the time domain and in the frequency domain and psychoacoustic characteristics of the human ear. The encoding methods may roughly be classified into time-domain encoding, frequency domain encoding and analysis/synthesis encoding.

Examples of the high-efficiency encoding of speech signals include sinusoidal analytic encoding, such as harmonic encoding or multi-band excitation (MBE) encoding, sub-band coding (SBC), linear predictive coding (LPC), discrete cosine transform (DCT), modified DCT (MDCT), and fast Fourier transform (FFT).

In the conventional MBE encoding or harmonic encoding, unvoiced speech portions are generated by a noise generating circuit. However, this method has a drawback that explosive consonants, such as p, k or t, or fricative consonants, cannot be produced correctly.

Moreover, if encoded parameters having totally different properties, such as line spectrum pairs (LSPs), are interpolated at a transient portion between a voiced (V) portion and an unvoiced (UV) portion, extraneous or foreign sounds tend to be produced. It being understood that by voiced is meant those sounds that have a discernable spectral distribution and by unvoiced is meant those sounds whose spectrum looks like noise.

In addition, with the conventional sinusoidal synthetic coding, low-pitch speech, particularly, male speech, tends to become unnatural "stuffed" speech.

SUMMARY OF THE INVENTION

It is therefore an object of the present invention to provide a speech encoding method and apparatus and a speech decoding method and apparatus whereby the explosive or fricative consonants can be correctly reproduced without the risk of a strange sound being generated in a transition portion between the voiced speech and the unvoiced speech, and whereby the speech of high clarity devoid of "stuffed" feeling can be produced.

With the speech encoding method of the present invention, in which an input speech signal is divided on the time axis in terms of pre-set encoding units and subsequently encoded in terms of the pre-set encoding units, short-term prediction residuals of the input speech signal are found, the short-term prediction residuals thus found are encoded with sinusoidal analytic encoding, and the input speech signal is encoded by waveform encoding.

The input speech signal is discriminated as to whether it is voiced or unvoiced. Based on the results of discrimination, the portion of the input speech signal judged to be voiced is encoded with the sinusoidal analytic encoding, while the portion thereof judged to be unvoiced is processed with vector quantization of the time-axis waveform by a closed-loop search of an optimum vector using an analysis-by-synthesis method.

It is preferred that, for the sinusoidal analytic encoding, perceptually weighted vector or matrix quantization is used for quantizing the short-term prediction residuals, and that, for such perceptually weighted vector or matrix quantization, the weight is calculated based on the results of orthogonal transform of parameters derived from the impulse response of the weight transfer function.

According to the present invention, the short-term prediction residuals, such as LPC residuals, of the input speech signal, are found, and the short-term prediction residuals are represented by a synthesized sinusoidal wave, while the input speech signal is encoded by waveform encoding of phase transmission of the input speech signal, thus realizing efficient encoding.

In addition, the input speech signal is discriminated as to whether it is voiced or unvoiced and, based on the results of discrimination, the portion of the input speech signal judged to be voiced is encoded by the sinusoidal analytic encoding, while the portion thereof judged to be unvoiced is processed with vector quantization of the time-axis waveform by the closed loop search of the optimum vector using the analysis-by-synthesis method, thereby improving the expressiveness of the unvoiced portion to produce a reproduced speech of high clarity. In particular, such effect is enhanced by raising the quantization rate. It is also possible to prevent extraneous sound from being produced at the transient portion between the voiced and unvoiced portions. The seeming synthesized speech at the voiced portion is diminished to produce more natural synthesized speech.

By calculating the weight at the time of weighted vector quantization of the parameters of the input signal converted into the frequency domain signal based on the results of orthogonal transform of the parameters derived from the impulse response of the weight transfer function, the processing volume may be diminished to a fractional value thereby simplifying the structure or expediting the processing operations.

DETAILED DESCRIPTION OF THE PREFERRED EMBODIMENTS

Figure 1:
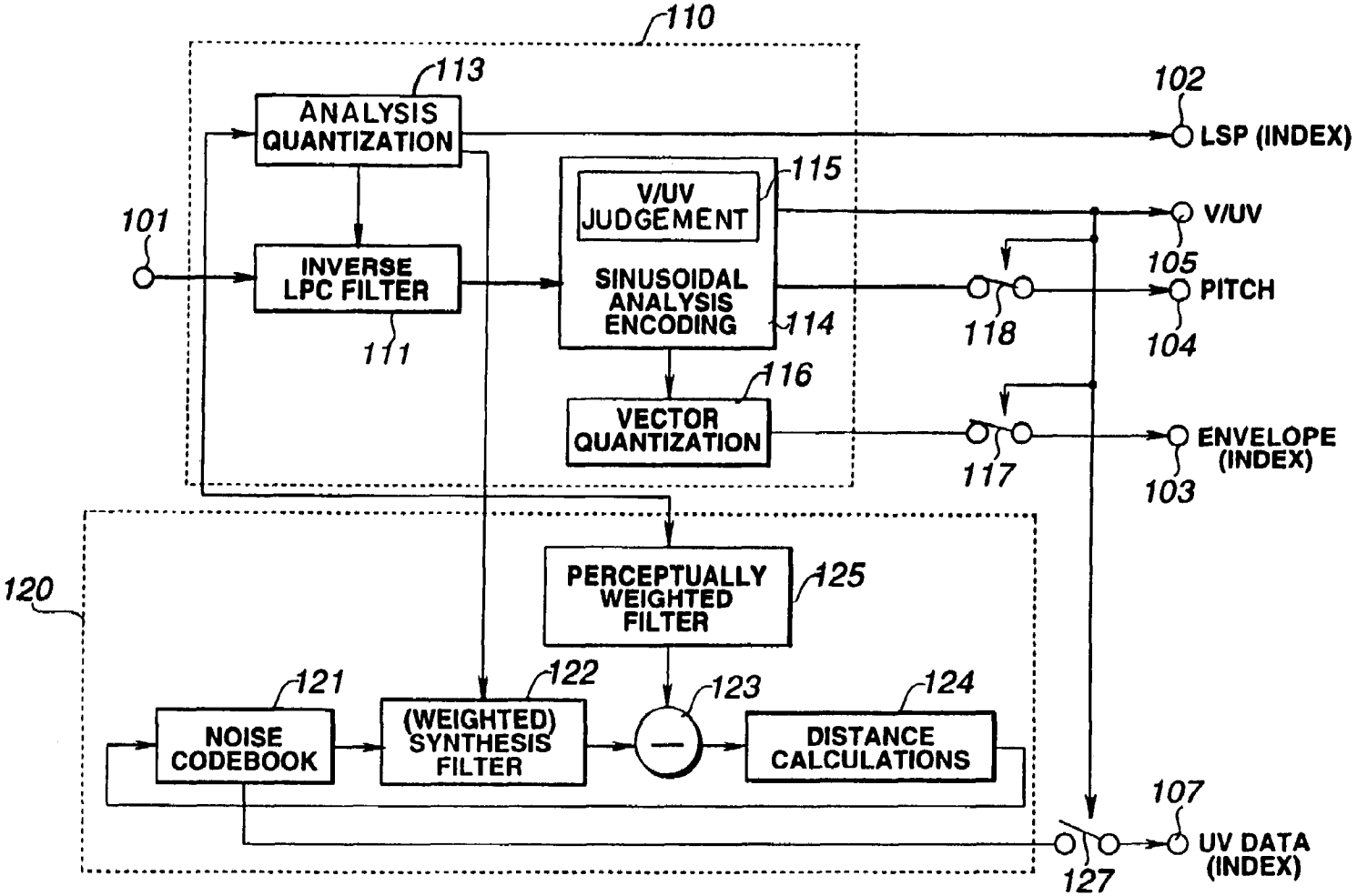
FIG. 1 is a block diagram showing a basic structure of a novel speech sign encoding apparatus (encoder) according to the present invention for carrying out the encoding method according to the present invention.

Referring to the drawings, preferred embodiments of the present invention will be explained in detail.

FIG. 1 shows the basic structure of an encoding apparatus (encoder) for carrying out a speech encoding method according to the present invention.

The basic concept underlying the speech signal encoder of FIG. 1 is that the encoder has a first encoding unit 110 for finding short-term prediction residuals, such as linear prediction encoding (LPC) residuals, of the input speech signal, in order to effect sinusoidal analysis, such as harmonic coding, and a second encoding unit 120 for encoding the input speech signal by waveform encoding having phase reproducibility, and that the first encoding unit 110 and the second encoding unit 120 are used for encoding the voiced (V) portion of the input signal and for encoding the unvoiced (UV) portion of the input signal, respectively.

The first encoding unit 110 employs the encoding of the LPC residuals, for example, with sinusoidal analytic encoding, such as harmonic encoding or multi-band excitation (MBE) encoding. The second encoding unit 120 performs code excited linear prediction (CELP) using vector quantization by closed loop search of an optimum vector and also uses, for example, an analysis by synthesis method.

In the embodiment shown in FIG. 1, the speech signal supplied to an input terminal 101 is sent to an LPC inverted filter 111 and an LPC analysis and quantization unit 113 of a first encoding unit 110. The LPC coefficients or the so-called α-parameters, obtained by an LPC analysis quantization unit 113, are sent to the LPC inverted filter 111 of the first encoding unit 110. From the LPC inverted filter 111 are taken out linear prediction residuals (LPC residuals) of the input speech signal. From the LPC analysis quantization unit 113, a quantized output of linear spectrum pairs (LSPs) are taken out and sent to an output terminal 102, as later explained. The LPC residuals from the LPC inverted filter 111 are sent to a sinusoidal analytic encoding unit 114. The sinusoidal analytic encoding unit 114 performs pitch detection and calculations of the amplitude of the spectral envelope as well as V/UV discrimination by a V/UV discrimination unit 115. The spectra envelope amplitude data from the sinusoidal analytic encoding unit 114 is sent to a vector quantization unit 116. The codebook index from the vector quantization unit 116, as a vector-quantized output of the spectral envelope, is sent via a switch 117 to an output terminal 103, while an output of the sinusoidal analytic encoding unit 114 is sent via a switch 118 to an output terminal 104. A V/UV discrimination output of the V/UV discrimination unit 115 is sent to an output terminal 105 and, as a control signal, to the switches 117, 118. If the input speech signal is a voiced (V) sound, the index and the pitch are selected and taken out at the output terminals 103, 104, respectively.

The second encoding unit 120 of FIG. 1 has, in the present embodiment, a code excited linear prediction coding (CELP coding) configuration, and vector-quantizes the time-domain waveform using a closed loop search employing an analysis by synthesis method in which an output of a noise codebook 121 is synthesized by a weighted synthesis filter 122. The resulting weighted speech is sent to one input of a subtractor 123 whose other input is the speech signal supplied to the input terminal 101 and thence through a perceptually weighting filter 125. The error thus found between the two inputs of the subtractor 123 is sent to a distance calculation circuit 124 to effect distance calculations and a vector minimizing the error is searched by the noise codebook 121. This CELP encoding is used for encoding the unvoiced speech portion, as explained previously. The codebook index, as the UV data from the noise codebook 121, is taken out at an output terminal 107 via a switch 127 which is turned on when the result of the V/UV discrimination is unvoiced (UV).

Figure 2:
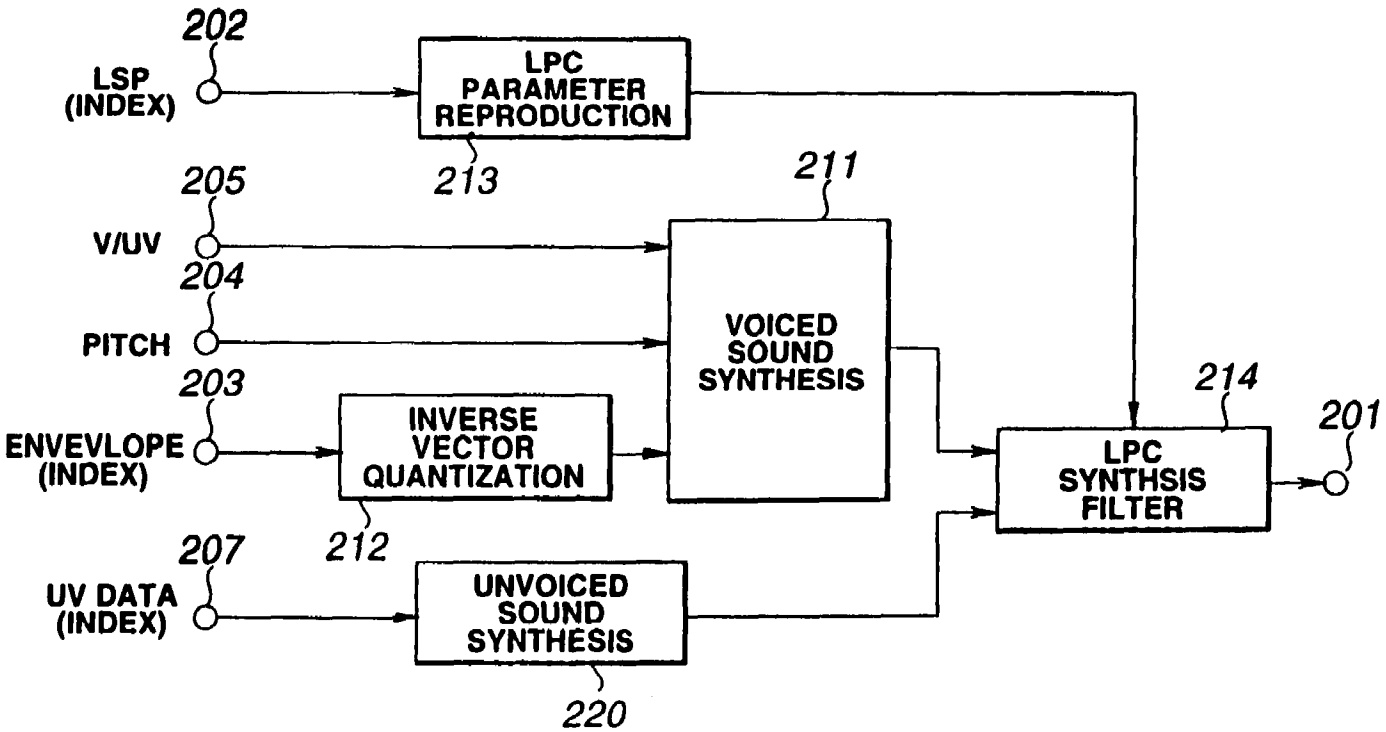
FIG. 2 is a block diagram showing a basic structure of a novel speech signal decoding apparatus (decoder) according to the present invention for carrying out the decoding method according to the present invention.

FIG. 2 is a block diagram showing the basic structure of a speech signal decoder, as a counterpart device of the speech signal encoder of FIG. 1, for carrying out the speech decoding method according to the present invention.

Referring to FIG. 2, a codebook index as a quantization output of the linear spectral pairs (LSPs) from the output terminal 102 of FIG. 1 is supplied to an input terminal 202. Outputs of the output terminals 104, 105, and 103 of FIG. 1, that is, the pitch, V/UV discrimination output, and the index data, as envelope quantization output data, are supplied respectively to input terminals 204, 205, and 203. The index data as data for the unvoiced data are supplied from the output terminal 107 of FIG. 1 to an input terminal 207.

The index as the envelope quantization output of the input terminal 203 is sent to an inverse vector quantization unit 212 for inverse vector quantization to find a spectral envelope of the LPC residues which is sent to a voiced speech synthesizer 211. The voiced speech synthesizer 211 synthesizes the linear prediction encoding (LPC) residuals of the voiced speech portion by sinusoidal synthesis. The synthesizer 211 is fed also with the pitch and the V/UV discrimination output from the input terminals 204, 205. The LPC residuals of the voiced speech from the voiced speech synthesis unit 211 are sent to an LPC synthesis filter 214. The index data of the UV data from the input terminal 207 is sent to an unvoiced sound synthesis unit 220 where reference is had to the noise codebook for taking out the LPC residuals of the unvoiced portion. These LPC residuals are also sent to the LPC synthesis filter 214. In the LPC synthesis filter 214, the LPC residuals of the voiced portion and the LPC residuals of the unvoiced portion are processed by LPC synthesis. Alternatively, the LPC residuals of the voiced portion and the LPC residuals of the unvoiced portion summed together may be processed with LPC synthesis. The LSP index data from the input terminal 202 is sent to the LPC parameter reproducing unit 213 where α-parameters of the LPC are taken out and sent to the LPC synthesis filter 214. The speech signals synthesized by the LPC synthesis filter 214 are taken out at an output terminal 201.

Figure 3:
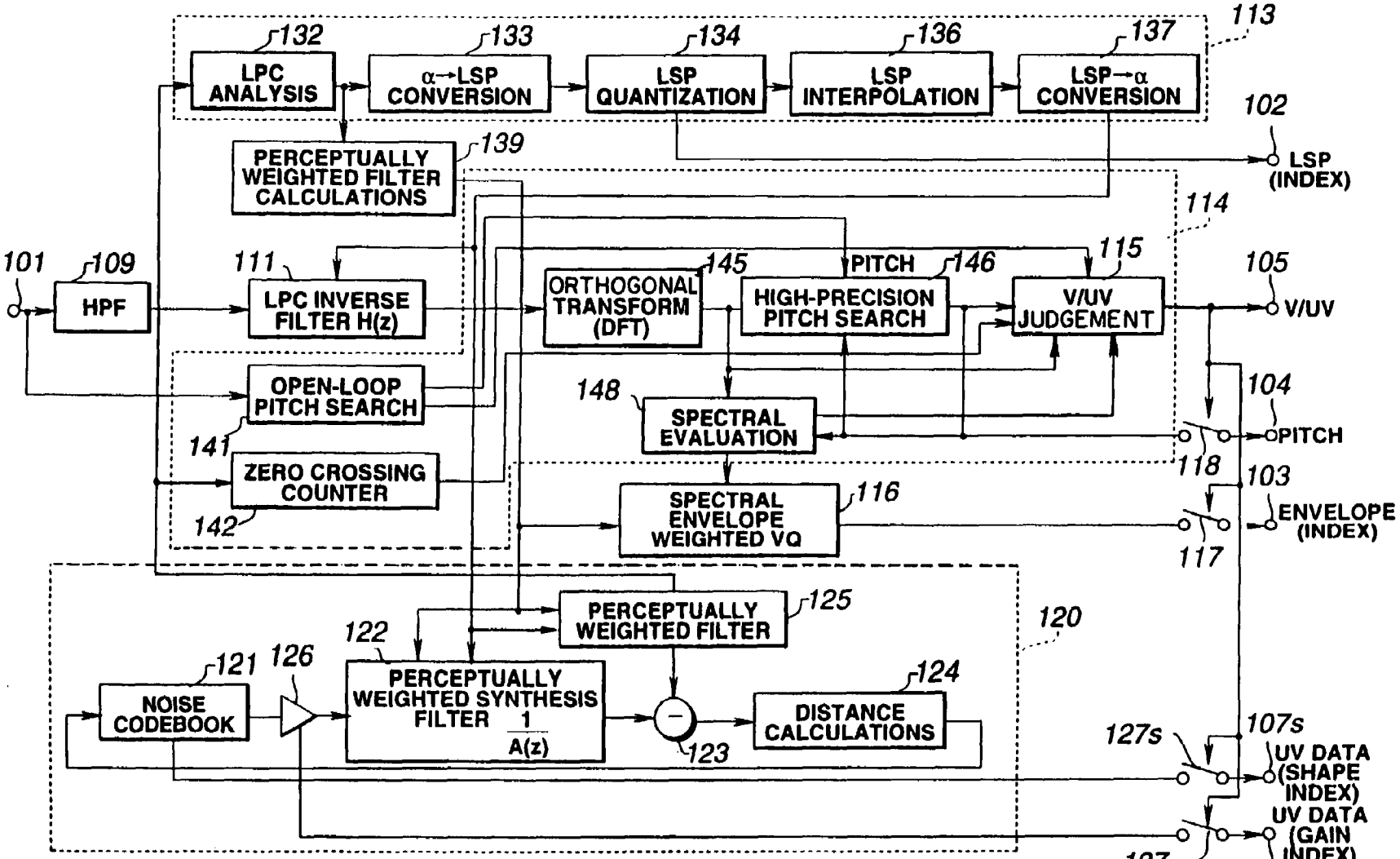
FIG. 3 is a block diagram showing the speech signal encoder shown in FIG. 1 in more detail.

Referring to FIG. 3, a more detailed structure of a speech signal encoder shown in FIG. 1 is now explained. In FIG. 3, the parts or components similar to those shown in FIG. 1 are denoted by the same reference numerals.

In the speech signal encoder shown in FIG. 3, the speech signals supplied to the input terminal 101 are filtered by a high-pass filter HPF 109 for removing signals of an unneeded range and thence supplied to an LPC analysis circuit 132 of the LPC analysis/quantization unit 113 and to the inverted LPC filter 111.

The LPC analysis circuit 132 of the LPC analysis/quantization unit 113 applies a Hamming window, with a length of the input signal waveform on the order of 256 samples as a block, and finds a linear prediction coefficient, that is a so-called α-parameter, by the autocorrelation method. The framing interval as a data outputting unit is set to approximately 160 samples. If the sampling frequency fs is 8 kHz, for example, a one-frame interval is 20 msec or 160 samples.

The α-parameter from the LPC analysis circuit 132 is sent to an α-LSP conversion circuit 133 for conversion into line spectrum pair (LSP) parameters. This converts the α-parameter, as found by direct type filter coefficient, into for example, ten, that is five pairs of the LSP parameters. This conversion is carried out by, for example, the Newton-Rhapson method. The reason the α-parameters are converted into the LSP parameters is that the LSP parameter is superior in interpolation characteristics to the α-parameters.

The LSP parameters from the α-LSP conversion circuit 133 are matrix- or vector quantized by the LSP quantizer 134. It is possible to take a frame-to-frame difference prior to vector quantization, or to collect plural frames in order to perform matrix quantization. In the present case, two frames, each 20 msec long, of the LSP parameters, calculated every 20 msec, are handled together and processed with matrix quantization and vector quantization.

The quantized output of the quantizer 134, that is the index data of the LSP quantization, are taken out at a terminal 102, while the quantized LSP vector is sent to an LSP interpolation circuit 136.

The LSP interpolation circuit 136 interpolates the LSP vectors, quantized every 20 msec or 40 msec, in order to provide an octatuple rate. That is, the LSP vector is updated every 2.5 msec. The reason is that, if the residual waveform is processed with the analysis/synthesis by the harmonic encoding/decoding method, the envelope of the synthetic waveform presents an extremely toothed waveform, so that, if the LPC coefficients are changed abruptly every 20 msec, a foreign noise is likely to be produced. That is, if the LPC coefficient is changed gradually every 2.5 msec, such foreign noise may be prevented from occurrence.

For inverted filtering of the input speech using the interpolated LSP vectors produced every 2.5 msec, the LSP parameters are converted by an LSP to α conversion circuit 137 into α-parameters, which are filter coefficients of e.g., ten-order direct type filter. An output of the LSP to α conversion circuit 137 is sent to the LPC inverted filter circuit 111 which then performs inverse filtering for producing a smooth output using an α-parameter updated every 2.5 msec. An output of the inverse LPC filter 111 is sent to an orthogonal transform circuit 145, such as a DCT circuit, of the sinusoidal analysis encoding unit 114, such as a harmonic encoding circuit.

The α-parameter from the LPC analysis circuit 132 of the LPC analysis/quantization unit 113 is sent to a perceptual weighting filter calculating circuit 139 where data for perceptual weighting is found. These weighting data are sent to a perceptual weighting vector quantizer 116, perceptual weighting filter 125 and the perceptual weighted synthesis filter 122 of the second encoding unit 120.

The sinusoidal analysis encoding unit 114 of the harmonic encoding circuit analyzes the output of the inverted LPC filter 111 by a method of harmonic encoding. That is, pitch detection, calculations of the amplitudes Am of the respective harmonics and voiced (V)/unvoiced (UV) discrimination, are carried out and the numbers of the amplitudes Am or the envelopes of the respective harmonics, varied with the pitch, are made constant by dimensional conversion.

In an illustrative example of the sinusoidal analysis encoding unit 114 shown in FIG. 3, commonplace harmonic encoding is used. In particular, in multi-band excitation (MBE) encoding, it is assumed in modelling that voiced portions and unvoiced portions are present in each frequency area or band at the same time point (in the same block or frame). In other harmonic encoding techniques, it is uniquely judged whether the speech in one block or in one frame is voiced or unvoiced. In the following description, a given frame is judged to be UV if the totality of the bands is UV, insofar as the MBE encoding is concerned. Specified examples of the technique of the analysis synthesis method for MBE as described above may be found in JP Patent Application No. 4-91442 filed in the name of the Assignee of the present Application.

The open-loop pitch search unit 141 and the zero-crossing counter 142 of the sinusoidal analysis encoding unit 114 of FIG. 3 are fed with the input speech signal from the input terminal 101 and with the signal from the high-pass filter (HPF) 109, respectively. The orthogonal transform circuit 145 of the sinusoidal analysis encoding unit 114 is supplied with LPC residuals or linear prediction residuals from the inverted LPC filter 111. The open loop pitch search unit 141 takes the LPC residuals of the input signals to perform a relatively rough or course pitch search by open loop processing. The extracted rough pitch data is sent to a fine pitch search unit 146 by closed loop search as later explained. From the open loop pitch search unit 141, the maximum value of the normalized self correlation r(p), obtained by normalizing the maximum value of the autocorrelation of the LPC residuals along with the rough pitch data, are taken out along with the rough pitch data so as to be sent to the V/UV discrimination unit 115.

The orthogonal transform circuit 145 performs orthogonal transform, such as discrete Fourier transform (DFT), for converting the LPC residuals on the time axis into spectral amplitude data on the frequency axis. An output of the orthogonal transform circuit 145 is sent to the fine pitch search unit 146 and a spectral evaluation unit 148 configured for evaluating the spectral amplitude or envelope.

The fine pitch search unit 146 is fed with relatively rough pitch data extracted by the open loop pitch search unit 141 and with frequency-domain data obtained by DFT by the orthogonal transform unit 145. The fine pitch search unit 146 swings the pitch data by plus-or-minus several samples, at a rate of 0.2 to 0.5, centered about the rough pitch value data, in order to arrive ultimately at the value of the fine pitch data having an optimum decimal point (floating point). The analysis by synthesis method is used as the fine search technique for selecting a pitch so that the power spectrum will be closest to the power spectrum of the original sound. Pitch data from the closed-loop fine pitch search unit 146 is sent to an output terminal 104 via a switch 118.

In the spectral evaluation unit 148, the amplitude of each of the harmonics and the spectral envelope as the sum of the harmonics are evaluated based on the spectral amplitude and the pitch as the orthogonal transform output of the LPC residuals, and sent to the fine pitch search unit 146, V/UV discrimination unit 115 and to the perceptually weighted vector quantization unit 116.

The V/UV discrimination unit 115 discriminates V/UV of a frame based on an output of the orthogonal transform circuit 145, an optimum pitch from the fine pitch search unit 146, spectral amplitude data from the spectral evaluation unit 148, maximum value of the normalized autocorrelation r(p) from the open loop pitch search unit 141 and the zero-crossing count value from the zero-crossing counter 142. In addition, the boundary position of the band-based V/UV discrimination for the MBE may also be used as a condition for V/UV discrimination. A discrimination output of the V/UV discrimination unit 115 is taken out at an output terminal 105.

An output unit of the spectrum evaluation unit 148 or an input unit of the vector quantization unit 116 may be provided with a number from a data conversion unit (a unit performing a sort of sampling rate conversion). The number from the data conversion unit may be used for setting the amplitude data |Am| of an envelope to a constant value in consideration that the number of bands split on the frequency axis and the number of data differ with the pitch. That is, if the effective band is up to 3400 kHz, the effective band can be split into 8 to 63 bands depending on the pitch. The number of mMX+1 of the amplitude data |Am|, obtained from band to band, is changed in a range from 8 to 63. Thus, the data number conversion unit (not shown) converts the amplitude data of the variable number mMx+1 to a pre-set number M of data, such as 44 data.

The amplitude data or envelope data of the pre-set number M, such as 44, from the data number conversion unit, provided at an output unit of the spectral evaluation unit 148 or at an input unit of the vector quantization unit 116, are handled together in terms of a pre-set number of data, such as 44 data, as a unit, by the vector quantization unit 116, by way of performing weighted vector quantization. This weight is supplied by an output of the perceptual weighting filter calculation circuit 139. The index of the envelope from the vector quantizer 116 is taken out by a switch 117 at an output terminal 103. Prior to weighted vector quantization, it is advisable to take inter-frame difference using a suitable leakage coefficient for a vector made up of a pre-set number of data.

The second encoding unit 120 is now further explained. The second encoding unit 120 has a so-called CELP encoding structure and is used in particular for encoding the unvoiced portion of the input speech signal. In the CELP encoding structure for the unvoiced portion of the input speech signal, a noise output, corresponding to the LPC residuals of the unvoiced sound, as a representative output value of the noise codebook, or a so-called stochastic codebook 121, is sent via a gain control circuit 126 to a perceptually weighted synthesis filter 122. The weighted synthesis filter 122 LPC synthesizes the input noise by LPC synthesis and sends the produced weighted unvoiced signal to the subtractor 123. The subtractor 123 is fed with a signal supplied from the input terminal 101 via an high-pass filter (HPF) 109 and perceptually weighted by a perceptual weighting filter 125. The subtractor finds the difference or error between the signal and the signal from the synthesis filter 122. Meanwhile, a zero input response of the perceptually weighted synthesis filter is previously subtracted from an output of the perceptual weighting filter output 125. This error is fed to a distance calculation circuit 124 for calculating the distance. A representative vector value which will minimize the error is searched in the noise codebook 121. The above is the summary of the vector quantization of the time-domain waveform employing the closed-loop search by the analysis by synthesis method.

As data for the unvoiced (UV) portion from the second encoder 120 employing the CELP coding structure, the shape index of the codebook from the noise codebook 121 and the gain index of the codebook from the gain circuit 126 are taken out. The shape index, which is the UV data from the noise codebook 121, is sent to an output terminal 107*s* via a switch 127*s*, while the gain index, which is the UV data of the gain circuit 126, is sent to an output terminal 107*g* via a switch 127*g*.

These switches 127*s*, 127*g* and the switches 117, 118 are turned on and off depending on the results of V/UV decision from the V/UV discrimination unit 115. Specifically, the switches 117, 118 are turned on, if the results of V/UV discrimination of the speech signal of the frame currently transmitted indicates voiced (V), while the switches 127*s*, 127*g* are turned on if the speech signal of the frame currently transmitted is unvoiced (UV).

Figure 4:
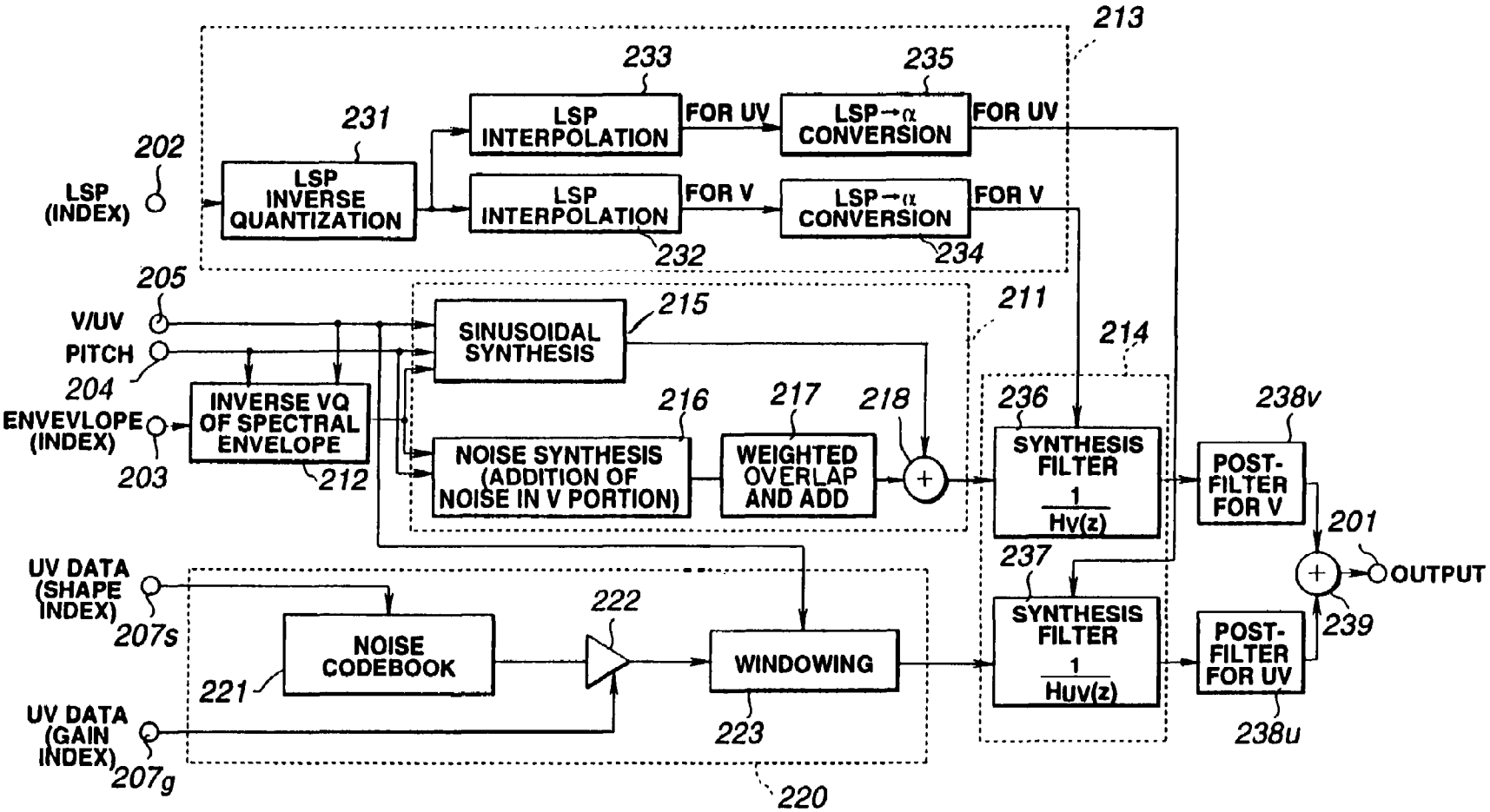
FIG. 4 is a block diagram showing the speech signal decoder shown in FIG. 2 in more detail.

FIG. 4 shows a more detailed structure of a speech signal decoder shown in FIG. 2. In FIG. 4, the same numerals are used to denote the components shown in FIG. 2.

In FIG. 4, a vector quantization output of the LSPs corresponding to the output terminal 102 of FIGS. 1 and 3, that is the codebook index, is supplied to an input terminal 202.

The LSP index is sent to the inverse vector quantizer 231 of the LSP for the LPC parameter reproducing unit 213 so as to be inverse vector quantized to line spectral pair (LSP) data which are then supplied to LSP interpolation circuits 232, 233 for interpolation. The resulting interpolated data is converted by the LSP to α conversion circuits 234, 235 to a parameters which are sent to the LPC synthesis filter 214. The LSP interpolation circuit 232 and the LSP to α conversion circuit 234 are designed for voiced (V) sound, while the LSP interpolation circuit 233 and the LSP to α conversion circuit 235 are designed for unvoiced (UV) sound. The LPC synthesis filter 214 is made up of the LPC synthesis filter 236 of the voiced speech portion and the LPC synthesis filter 237 of the unvoiced speech portion. That is, LPC coefficient interpolation is carried out independently for the voiced speech portion and the unvoiced speech portion for prohibiting ill effects which might otherwise be produced in the transient portion from the voiced speech portion to the unvoiced speech portion or vice versa by interpolation of the LSPs of different properties.

To an input terminal 203 of FIG. 4 is supplied code index data corresponding to the weighted vector quantized spectral envelope Am corresponding to the output of the terminal 103 of the encoder of FIGS. 1 and 3. To an input terminal 204 is supplied pitch data from the terminal 104 of FIGS. 1 and 3 and, to an input terminal 205 is supplied V/UV discrimination data from the terminal 105 of FIGS. 1 and 3.

The vector-quantized index data of the spectral envelope Am from the input terminal 203 is sent to an inverse vector quantizer 212 for inverse vector quantization where a conversion inverted from the data number conversion is carried out. The resulting spectral envelope data is sent to a sinusoidal synthesis circuit 215.

If the inter-frame difference is found prior to vector quantization of the spectrum during encoding, inter-frame difference is decoded after inverse vector quantization for producing the spectral envelope data.

The sinusoidal synthesis circuit 215 is fed with the pitch from the input terminal 204 and the V/UV discrimination data from the input terminal 205. From the sinusoidal synthesis circuit 215, LPC residual data corresponding to the output of the LPC inverse filter 111 shown in FIGS. 1 and 3 are taken out and sent to an adder 218. The specified technique of the sinusoidal synthesis is disclosed in, for example, JP Patent Application Nos. 4-91442 and 6-198451 proposed by the present Assignee.

The envelope data of the inverse vector quantizer 212 and the pitch and the V/UV discrimination data from the input terminals 204, 205 are sent to a noise synthesis circuit 216 configured for noise addition for the voiced portion (V). An output of the noise synthesis circuit 216 is sent to an adder 218 via a weighted overlap-and-add circuit 217. Specifically, the noise is added to the voiced portion of the LPC residual signals in consideration that, if the excitation as an input to the LPC synthesis filter of the voiced sound is produced by sine wave synthesis, a "stuffed" feeling is produced in the low-pitch sound, such as male speech, and the sound quality is abruptly changed between the voiced sound and the unvoiced sound, thus producing an unnatural sound. Such noise takes into account the parameters concerned with speech encoding data, such as pitch, amplitudes of the spectral envelope, maximum amplitude in a frame or the residual signal level, in connection with the LPC synthesis filter input of the voiced speech portion, that is excitation.

A sum output of the adder 218 is sent to a synthesis filter 236 for the voiced sound of the LPC synthesis filter 214 where LPC synthesis is carried out to form time waveform data which then is filtered by a post-filter 238*v* for the voiced speech and sent to the adder 239.

The shape index and the gain index, as UV data from the output terminals 107*s* and 107*g* of FIG. 3, are supplied to the input terminals 207*s* and 207*g* of FIG. 4, respectively, and thence supplied to the unvoiced speech synthesis unit 220. The shape index from the terminal 207*s* is sent to the noise codebook 221 of the unvoiced speech synthesis unit 220, while the gain index from the terminal 207*g* is sent to the gain circuit 222. The representative value read out from the noise codebook 221 is a noise signal component corresponding to the LPC residuals of the unvoiced speech. This becomes a pre-set gain amplitude in the gain circuit 222 and is sent to a windowing circuit 223 so as to be windowed for smoothing the junction to the voiced speech portion.

An output of the windowing circuit 223 is sent to a synthesis filter 237 for the unvoiced (UV) speech of the LPC synthesis filter 214. The data sent to the synthesis filter 237 is processed with LPC synthesis to become time waveform data for the unvoiced portion. The time waveform data of the unvoiced portion is filtered by a post-filter for the unvoiced portion 238*u* before being sent to an adder 239.

In the adder 239, the time waveform signal from the post-filter for the voiced speech 238*v* and the time waveform data for the unvoiced speech portion from the post-filter for the unvoiced speech 238*u* are added to each other and the resulting sum data is taken out at the output terminal 201.

The above-described speech signal encoder can output data of different bit rates depending on the required sound quality. That is, the output data can be output with variable bit rates. For example, if the low bit rate is 2 kbps and the high bit rate is 6 kbps, the output data is data of the bit rates having the following bit rates shown in Table 1.

TABLE 1

| | 2 kbps | 6 kbps |
|---|---|---|
| U/V decision output | 1 bit/20 msec | 1 bit/20 msec |
| LSP quantization index for voiced speech (V) | 32 bits/40 msec<br>pitch data 8 bits/20 msec<br>index 15 bits/20 msec<br>shape (for first stage), 5 + 5 bits/20 msec<br>gain, 5 bits/20 msec | 48 bits/40 msec<br>pitch data 8 bits/20 msec<br>index data 87 bits/20 msec<br>shape (for first stage), 5 + 5 bits/20 msec<br>gain, 5 bits/20 msec<br>gain, (for second stage), 72 bits/20 msec |
| for unvoiced speech (UV) | index 11 bits/10 msec<br>shape (for first stage), 7 bits/10 msec<br>gain, 4 bits<br>10 msec | index 23 bits/5 msec<br>shape for first stage, 9 bits/5 msec<br>gain, 6 bits/5 msec<br>shape for second stage, 5 bits/5 msec<br>gain, 3 bits/5 msec |
| for voiced speech | 40 bits/20 msec | 120 bits/20 msec |
| for unvoiced speech | 39 bits/20 msec | 117 bits/20 msec |

The pitch data from the output terminal 104 is output at all times at a bit rate of 8 bits/20 msec for the voiced speech, with the V/UV discrimination output from the output terminal 105 being at all times 1 bit/20 msec. The index for LSP quantization, output from the output terminal 102, is switched between 32 bits/40 msec and 48 bits/40 msec. On the other hand, the index during the voiced speech (V) output by the output terminal 103 is switched between 15 bits/20 msec and 87 bits/20 msec. The index for the unvoiced (UV) output from the output terminals 107*s* and 107*g* is switched between 11 bits/10 msec and 23 bits/5 msec. The output data for the voiced sound (UV) is 40 bits/20 msec for 2 kbps and 120 kbps/20 msec for 6 kbps. On the other hand, the output data for the voiced sound (UV) is 39 bits/20 msec for 2 kbps and 117 kbps/20 msec for 6 kbps.

The index for LSP quantization, the index for voiced speech (V) and the index for the unvoiced speech (UV) are explained later on in connection with the arrangement of pertinent portions.

Figure 5:
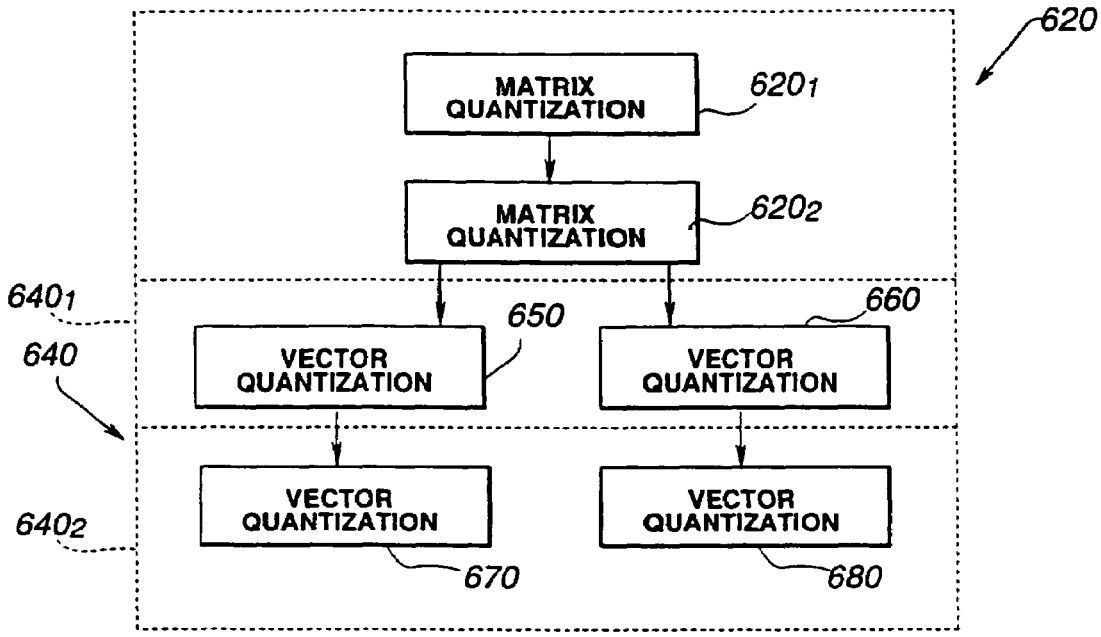
FIG. 5 is a block diagram showing a basic structure of an LPC quantizer.
Figure 6:
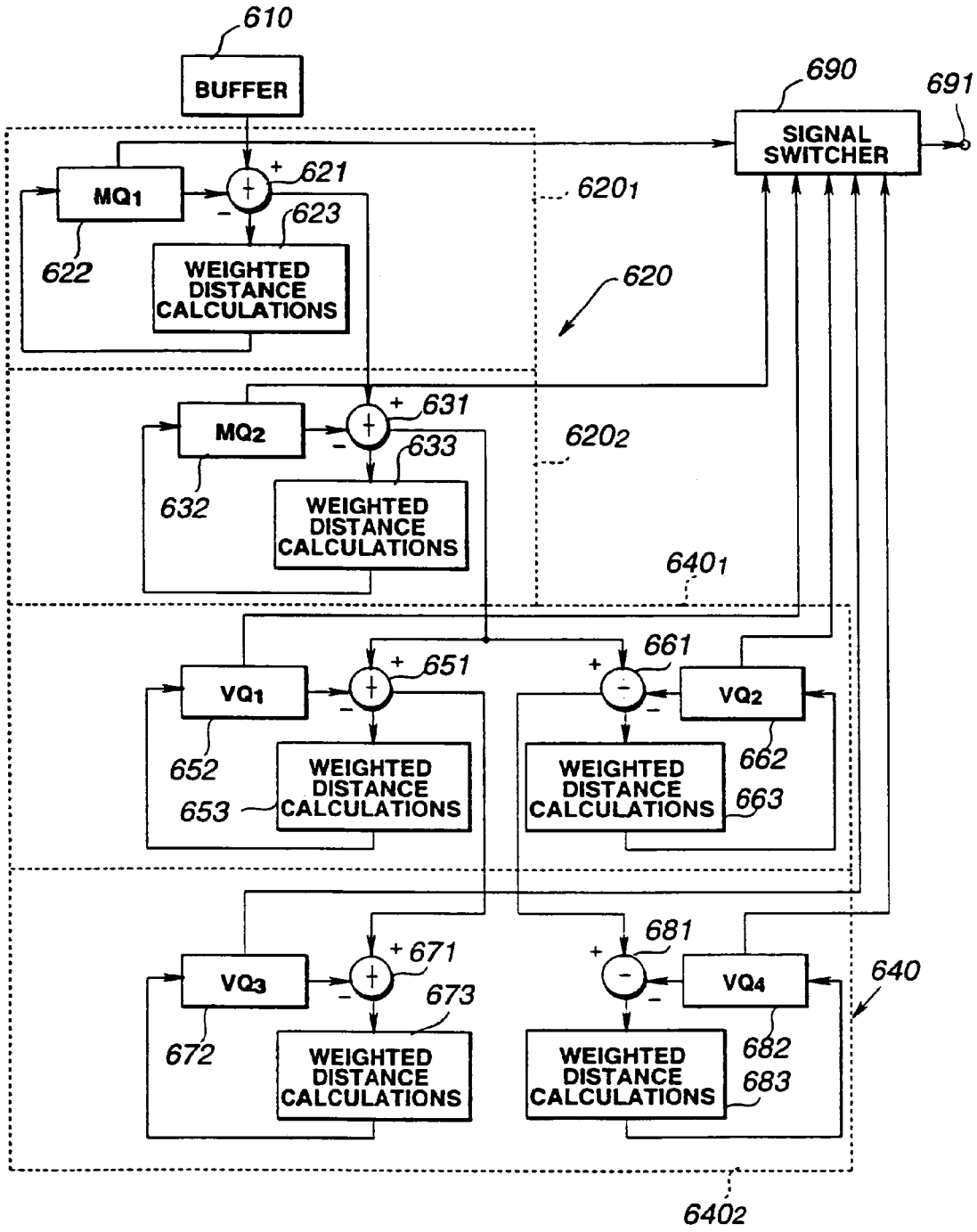
FIG. 6 is a lock diagram showing a more detailed structure of the LPC quantizer of FIG. 5.

Referring to FIGS. 5 and 6, matrix quantization and vector quantization in the LSP quantizer 134 are explained in more detail.

The α-parameter from the LPC analysis circuit 132 is sent to an α-LSP circuit 133 for conversion to LSP parameters. If the P-order LPC analysis is performed in a LPC analysis circuit 132, P α-parameters are calculated. These P α-parameters are converted into LSP parameters which are held in a buffer 610 of FIG. 6.

The buffer 610 outputs 2 frames of LSP parameters. The two frames of the LSP parameters are matrix-quantized by a matrix quantizer 620 made up of a first matrix quantizer $\mathbf{620}_1$ and a second matrix quantizer $\mathbf{620}_2$. The two frames of the LSP parameters are matrix-quantized in the first matrix quantizer $\mathbf{620}_1$ and the resulting quantization error is further matrix-quantized in the second matrix quantizer $\mathbf{620}_2$. The matrix quantization exploits correlation in both the time axis and in the frequency axis. The quantization error for two frames from the matrix quantizer 620$_2$ enters a vector quantization unit 640 made up of a first vector quantizer 640$_1$ and a second vector quantizer 640. The first vector quantizer 640$_1$ is made up of two vector quantization portions 650, 660, while the second vector quantizer 640$_2$ is made up of two vector quantization portions 670, 680. The quantization error from the matrix quantization unit 620 is quantized on the frame basis by the vector quantization portions 650, 660 of the first vector quantizer 640$_1$. The resulting quantization error vector is further vector-quantized by the vector quantization portions 670, 680 of the second vector quantizer 640$_2$. The above described vector quantization exploits correlation along the frequency axis.

The matrix quantization unit 620, executing the matrix quantization as described above, includes at least a first matrix quantizer 620$_1$ for performing a first matrix quantization step and a second matrix quantizer 620$_2$ for performing a second matrix quantization step for matrix quantizing the quantization error produced by the first matrix quantization. The vector quantization unit 640, executing the vector quantization as described above, includes at least a first vector quantizer 640$_1$ for performing a first vector quantization step and a second vector quantizer 640$_2$ for performing a second matrix quantization step for matrix quantizing the quantization error produced by the first vector quantization.

The matrix quantization and the vector quantization will now be explained in detail.

The LSP parameters for two frames, stored in the buffer 610, that is a 10×2 matrix, is sent to the first matrix quantizer 620$_1$. The first matrix quantizer 620$_1$ sends LSP parameters for two frames via LSP parameter adder 621 to a weighted distance calculating unit 623 for finding the weighted distance of the minimum value.

The distortion measure $d_{MQ1}$ during codebook search by the first matrix quantizer 620$_1$ is given by the equation (1):

$$d_{MQ1}(X_1, X_1') = \sum_{t=0}^{1} \sum_{i=1}^{P} w(t, i)(x_1(t, i) - x_1'(t, i))^2 \tag{1}$$

where $X_1$ is the LSP parameter and $X_1$ is the quantization value, with t and i being the numbers of the P-dimension.

The weight w, in which weight limitation in the frequency axis and in the time axis is not taken into account, is given by the equation (2):

$$w(t, i) = \frac{1}{x(t, i+1) - x(t, i)} + \frac{1}{x(t, i) - x(t, i-1)} \tag{2}$$

where x(t, 0)=0, x(t, p+1)=π regardless of t.

The weight w of the equation (2) is also used for downstream side matrix quantization and vector quantization.

The calculated weighted distance is sent to a matrix quantizer $MQ_1$ 622 for matrix quantization. An 8-bit index output by this matrix quantization is sent to a signal switcher 690. The quantized value by matrix quantization is subtracted in an adder 621 from the LSP parameters for two frames from the buffer 610. A weighted distance calculating unit 623 calculates the weighted distance every two frames so that matrix quantization is carried out in the matrix quantization unit 622. Also, a quantization value minimizing the weighted distance is selected. An output of the adder 621 is sent to an adder 631 of the second matrix quantizer 620$_2$.

Similarly to the first matrix quantizer 620$_1$, the second matrix quantizer 620$_2$ performs matrix quantization. An output of the adder 621 is sent via adder 631 to a weighted distance calculation unit 633 where the minimum weighted distance is calculated.

The distortion measure $d_{MQ2}$ during the codebook search by the second matrix quantizer 620$_2$ is given by the equation (3):

$$d_{MQ2}(X_2, X_2') = \sum_{t=0}^{1} \sum_{i=1}^{P} w(t, i)(x_2(t, i) - x_2'(t, i))^2 \tag{3}$$

The weighted distance is sent to a matrix quantization unit ($MQ_2$) 632 for matrix quantization. An 8-bit index, output by matrix quantization, is sent to a signal switcher 690. The weighted distance calculation unit 633 sequentially calculates the weighted distance using the output of the adder 631. The quantization value minimizing the weighted distance is selected. An output of the adder 631 is sent to the adders 651, 661 of the first vector quantizer 640$_1$ frame by frame.

The first vector quantizer 640$_1$ performs vector quantization frame by frame. An output of the adder 631 is sent frame by frame to each of weighted distance calculating units 653, 663 via adders 651, 661 for calculating the minimum weighted distance.

The difference between the quantization error $X_2$ and the quantization error $X_2'$ is a matrix of (10×2). If the difference is represented as $X_2 - X_2 = [\underline{x}_{3-1}, \underline{x}_{3-2}]$, the distortion measures $d_{VQ1}$, $d_{VQ2}$ during codebook search by the vector quantization units 652, 662 of the first vector quantizer 640$_1$ are given by the equations (4) and (5):

$$d_{VQ1}(\underline{x}_{3-1}, \underline{x}_{3-1}') = \sum_{i=1}^{P} w(0, i)(x_{3-1}(0, i) - x_{3-1}'(0, i))^2 \tag{4}$$

$$d_{VQ2}(x_{3-2}, x_{3-2}') = \sum_{i=1}^{P} w(1, i)(x_{3-2}(1, i) - x_{3-2}'(1, i))^2 \tag{5}$$

The weighted distance is sent to a vector quantization unit $VQ_1$ 652 and a vector quantization unit $VQ_2$ 662 for vector quantization. Each 8-bit index output by this vector quantization is sent to the signal switcher 690. The quantization value is subtracted by the adders 651, 661 from the input two-frame quantization error vector. The weighted distance calculating units 653, 663 sequentially calculate the weighted distance, using the outputs of the adders 651, 661, for selecting the quantization value minimizing the weighted distance. The outputs of the adders 651, 661 are sent to adders 671, 681 of the second vector quantizer 640$_2$.

The distortion measure $d_{VQ3}$, $d_{VQ4}$ during codebook searching by the vector quantizers 672, 682 of the second vector quantizer 640$_2$, for $$\underline{x}_{4-1} = x_{3-1} - \underline{x}_{3-1}'$$

$$\underline{x}_{4-2} = x_{3-2} - \underline{x}_{3-2}'$$

are given by the equations (6) and (7):

$$d_{VQ3}(\underline{x}_{4-1}, \underline{x}'_{4-1}) = \sum_{i=1}^{P} w(0, i)(x_{4-1}(0, i) - x'_{4-1}(0, i))^2 \quad (6)$$

$$d_{VQ4}(\underline{x}_{4-2}, \underline{x}'_{4-2}) = \sum_{i=1}^{P} w(1, i)(x_{4-2}(1, i) - x'_{4-2}(1, i))^2 \quad (7)$$

These weighted distances are sent to the vector quantizer ($VQ_3$) 672 and to the vector quantizer ($VQ_4$) 682 for vector quantization. The 8-bit output index data from vector quantization are subtracted by the adders 671, 681 from the input quantization error vector for two frames. The weighted distance calculating units 673, 683 sequentially calculate the weighted distances using the outputs of the adders 671, 681 for selecting the quantized value minimizing the weighted distances.

During codebook learning, learning is performed by the general Lloyd algorithm based on the respective distortion measures.

The distortion measures during codebook searching and during learning may be of the same or different values.

The 8-bit index data from the matrix quantization units 622, 632 and the vector quantization units 652, 662, 672 and 682 are switched by the signal switcher 690 and output at an output terminal 691.

Specifically, for a low-bit rate, outputs of the first matrix quantizer $\mathbf{620}_1$ carrying out the first matrix quantization step, second matrix quantizer $\mathbf{620}_2$ carrying out the second matrix quantization step, and the first vector quantizer $\mathbf{640}_1$ carrying out the first vector quantization step are taken out, whereas, for a high bit rate, the output for the low bit rate is summed to an output of the second vector quantizer $\mathbf{640}_2$ carrying out the second vector quantization step and the resulting sum is taken out.

This produces an index of 32 bits/40 msec and an index of 48 bits/40 msec for 2 kbps and 6 kbps, respectively.

The matrix quantization unit 620 and the vector quantization unit 640 perform weighting limited in the frequency axis and/or the time axis in conformity to characteristics of the parameters representing the LPC coefficients.

The weighting limited in the frequency axis in conformity to characteristics of the LSP parameters is first explained. If the number of orders P=10, the LSP parameters X(i) are grouped into $$L_1=\{X(i) \mid 1 \leqq i \leqq 2\}$$

$$L_2=\{X(i) \mid 3 \leqq i \leqq 6\}$$

$$L_3=\{X(i) \mid 7 \leqq i \leqq 10\}$$

for three ranges of low, mid and high ranges. If the weighting of the groups $L_1$, $L_2$ and $L_3$ is ¼, ½ and ¼, respectively, the weighting limited only in the frequency axis is given by the equations (8), (9) and (10)

$$w'(i) = \frac{w(i)}{\sum_{j=1}^{2} w(j)} \times \frac{1}{4} \quad (8)$$

$$w'(i) = \frac{w(i)}{\sum_{j=3}^{6} w(j)} \times \frac{1}{2} \quad (9)$$

-continued $$w'(i) = \frac{w(i)}{\sum_{j=7}^{10} w(j)} \times \frac{1}{4} \quad (10)$$

The weighting of the respective LSP parameters is performed in each group only and such weight is limited by the weighting for each group.

Looking in the time axis direction, the sum total of the respective frames is necessarily 1, so that limitation in the time axis direction is frame-based. The weight limited only in the time axis direction is given by the equation (11):

$$w'(i, t) = \frac{w(i, t)}{\sum_{j=1}^{10} \sum_{s=0}^{1} w(j, s)} \quad (11)$$

where $1 \leqq i \leqq 10$ and $0 \leqq t \leqq 1$.

By this equation (11), weighting not limited in the frequency axis direction is carried out between two frames having the frame numbers of t=0 and t=1. This weighting limited only in the time axis direction is carried out between two frames processed with matrix quantization.

During learning, the totality of frames used as learning data, having the total number T, is weighted in accordance with the equation (12):

$$w'(i, t) = \frac{w(i, t)}{\sum_{j=1}^{10} \sum_{s=0}^{T} w(j, s)} \quad (12)$$

where $1 \leqq i \leqq 10$ and $0 \leqq t \leqq T$.

The weighting limited in the frequency axis direction and in the time axis direction is explained. If the number of orders P=10, the LSP parameters x(i, t) are grouped into $$L_1=\{x(i, t) \mid 1 \leqq i \leqq 2, 0 \leqq t \leqq 1\}$$

$$L_2=\{x(i, t) \mid 3 \leqq i \leqq 6, 0 \leqq t \leqq 1\}$$

$$L_3=\{x(i, t) \mid 7 \leqq i \leqq 10, 0 \leqq t \leqq 1\}$$

for three ranges of low, mid and high ranges. If the weights for the groups $L_1$, $L_2$ and $L_3$ are ¼, ½ and ¼, the weighting limited only in the frequency axis is given by the equations (13), (14) and (15):

$$w'(i, t) = \frac{w(i, t)}{\sum_{j=1}^{2} \sum_{s=0}^{1} w(j, s)} \times \frac{1}{4} \quad (13)$$

$$w'(i, t) = \frac{w(i, t)}{\sum_{j=3}^{6} \sum_{s=0}^{1} w(j, s)} \times \frac{1}{2} \quad (14)$$

$$w'(i, t) = \frac{w(i, t)}{\sum_{j=7}^{10} \sum_{s=0}^{1} w(j, s)} \times \frac{1}{4} \quad (15)$$

By these equations (13) to (15) weighting limited every three frames in the frequency axis direction and across two frames processed with matrix quantization is carried out. This is effective both during codebook search and during learning.

During learning, weighting is for the totality of frames of the entire data. The LSP parameters x(i, t) are grouped into $$L_1=\{x(i,t)|1\leqq i\leqq 2,\ 0\leqq t\leqq T\}$$

$$L_2=\{x(i,t)|3\leqq i\leqq 6,\ 0\leqq t\leqq T\}$$

$$L_3=\{x(i,t)|7\leqq i\leqq 10,\ 0\leqq t\leqq T\}$$

for low, mid and high ranges. If the weighting of the groups $L_1$, $L_2$ and $L_3$ is ¼, ½ and ¼, respectively, the weighting for the groups $L_1$, $L_2$ and $L_3$, limited only in the frequency axis, is given by the equations (16), (17) and (18):

$$w'(i,t)=\frac{w(i,t)}{\sum_{j=1}^{2}\sum_{s=0}^{T}w(j,s)}\times\frac{1}{4} \tag{16}$$

$$w'(i,t)=\frac{w(i,t)}{\sum_{j=3}^{6}\sum_{s=0}^{T}w(j,s)}\times\frac{1}{2} \tag{17}$$

$$w'(i,t)=\frac{w(i,t)}{\sum_{j=7}^{10}\sum_{s=0}^{T}w(j,s)}\times\frac{1}{4} \tag{18}$$

By these equations (16) to (18), weighting can be performed for three ranges in the frequency axis direction and across the totality of frames in the time axis direction.

In addition, the matrix quantization unit 620 and the vector quantization unit 640 perform weighting depending on the magnitude of changes in the LSP parameters. In V to UV or UV to V transient regions, which represent minority frames among the totality of speech frames, the LSP parameters are changed significantly due to differences in the frequency response between consonants and vowels. Therefore, the weighting shown by the equation (19) may be multiplied by the weighting W'(i, t) for carrying out the weighting placing emphasis on the transition regions.

$$wd(t)=\sum_{i=1}^{10}|x_1(i,t)-x_1(i,t-1)|^2 \tag{19}$$

The following equation (20):

$$wd(t)=\sum_{i=1}^{10}\sqrt{|x_1(i,t)-x_1(i,t-1)|} \tag{20}$$

may be used in place of the equation (19).

Thus the LSP quantization unit 134 executes two-stage matrix quantization and two-stage vector quantization to render the number of bits of the output index variable.

Figure 7:
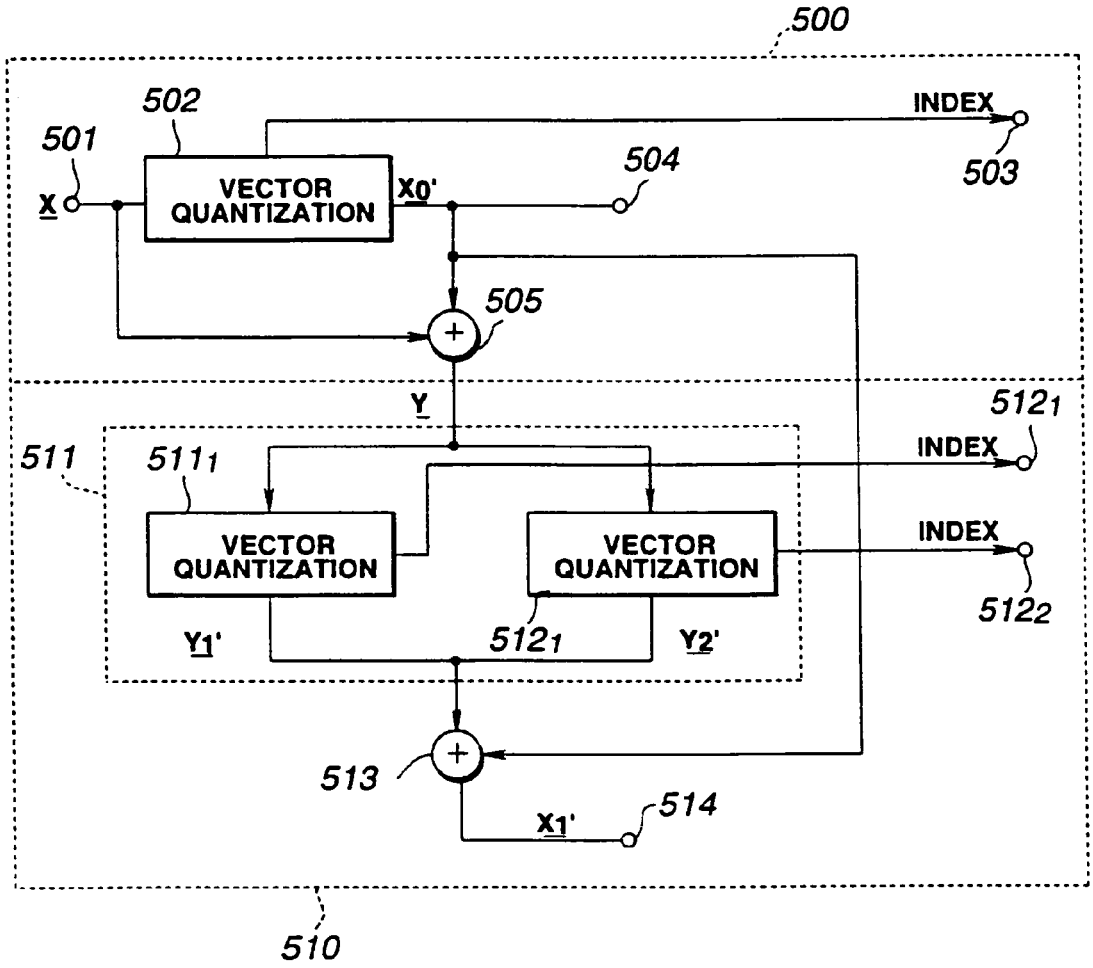
FIG. 7 is a block diagram showing a basic structure of the vector quantizer.
Figure 8:
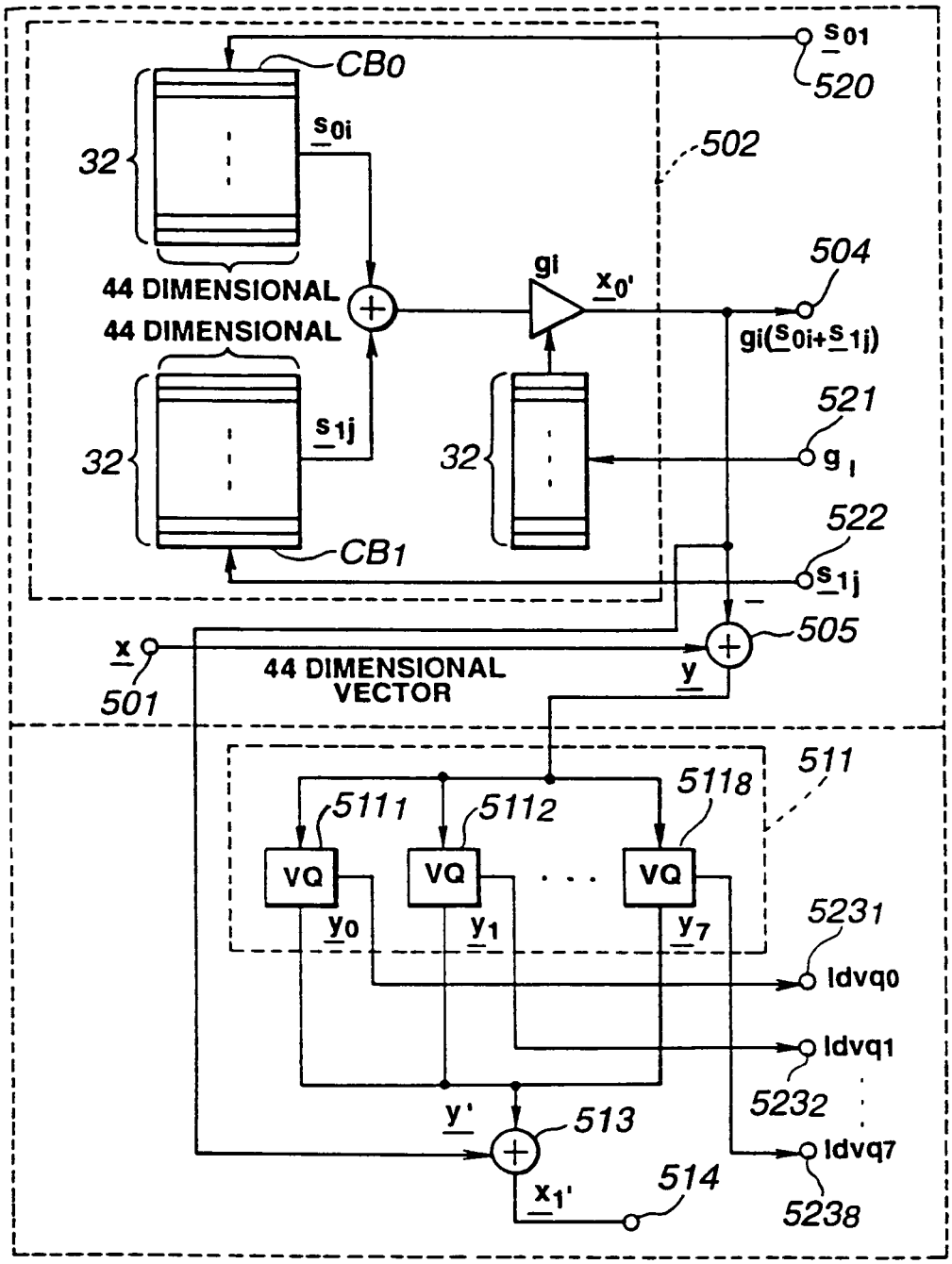
FIG. 8 is a block diagram showing a more detailed structure of the vector quantizer of FIG. 7.

The basic structure of the vector quantization unit 116 is shown in FIG. 7, while a more detailed structure of the vector quantization unit 116 is shown in FIG. 8. An illustrative structure of weighted vector quantization for the spectral envelope Am in the vector quantization unit 116 is now explained.

First, in the speech signal encoding device shown in FIG. 3, an illustrative arrangement for data number conversion for providing a constant number of data of the amplitude of the spectral envelope on an output side of the spectral evaluating unit 148 or on an input side of the vector quantization unit 116 is explained.

A variety of methods may be conceived for such data number conversion. In the present embodiment, dummy data interpolating the values from the last data in a block to the first data in the block, or pre-set data such as data repeating the last data or the first data in a block, are appended to the amplitude data of one block of an effective band on the frequency axis for enhancing the number of data to $N_F$, amplitude data equal in number to Os times, such as eight times, are found by Os-tuple, such as octatuple, oversampling of the limited bandwidth type. The ((mMx+1)×Os) amplitude data are linearly interpolated for expansion to a larger $N_M$ number, such as 2048. This $N_M$ data is sub-sampled for conversion to the above-mentioned pre-set number M of data, such as 44 data. In effect, only data necessary for formulating M data ultimately required is calculated by oversampling and linear interpolation without finding all of the above-mentioned $N_M$ data.

The vector quantization unit 116 for carrying out weighted vector quantization of FIG. 7 at least includes a first vector quantization unit 500 for performing the first vector quantization step and a second vector quantization unit 510 for carrying out the second vector quantization step for quantizing the quantization error vector produced during the first vector quantization by the first vector quantization unit 500. This first vector quantization unit 500 is a so-called first-stage vector quantization unit, while the second vector quantization unit 510 is a so-called second-stage vector quantization unit.

An output vector $\underline{x}$ of the spectral evaluation unit 148, that is envelope data having a pre-set number M, enters an input terminal 501 of the first vector quantization unit 500. This output vector $\underline{x}$ is quantized with weighted vector quantization by the vector quantization unit 502. Thus, a shape index output by the vector quantization unit 502 is output at an output terminal 503, while a quantized value $\underline{x}_0'$ is output at an output terminal 504 and sent to adders 505, 513. The adder 505 subtracts the quantized value $\underline{x}_0'$ from the source vector $\underline{x}$ to give a multi-order quantization error vector y.

The quantization error vector y is sent to a vector quantization unit 511 in the second vector quantization unit 510. This second vector quantization unit 511 is made up of plural vector quantizers, or two vector quantizers 511$_1$, 511$_2$ in FIG. 7. The quantization error vector y is dimensionally split so as to be quantized by weighted vector quantization in the two vector quantizers 511$_1$, 511$_2$. The shape index output by these vector quantizers 511$_1$, 511$_2$ is output at output terminals 512$_1$, 512$_2$, while the quantized values $y_1'$, $y_2'$ are connected in the dimensional direction and sent to an adder 513. The adder 513 adds the quantized values $y_1'$, $y_2'$ to the quantized value $\underline{x}_0'$ to generate a quantized value $\underline{x}_1'$ which is outputted at an output terminal 514.

Thus, for the low bit rate, an output of the first vector quantization step by the first vector quantization unit 500 is taken out, whereas, for the high bit rate, an output of the first vector quantization step and an output of the second quantization step by the second quantization unit 510 are outputted.

Specifically, the vector quantizer 502 in the first vector quantization unit 500 in the vector quantization section 116 is of an L-order, such as 44-dimensional two-stage structure, as shown in FIG. 8.

That is, the sum of the output vectors of the 44-dimensional vector quantization codebook with the codebook size of 32, multiplied with a gain $g_i$, is used as a quantized value $\underline{x}_0'$ of the 44-dimensional spectral envelope vector x. Thus, as shown in FIG. 8, the two codebooks are CB0 and CB1, while the output vectors are $s_{1i}$, $s_{1j}'$, where 0≦i and j≦31. On the other hand, an output of the gain codebook $CB_g$ is $g_l$, where 0≦l≦31, where $g_l$ is a scalar. An ultimate output $\underline{x}_0'$ is $g_l(s_{1i}+s_{1j})$.

The spectral envelope Am obtained by the above MBE analysis of the LPC residuals and converted into a pre-set dimension is $\underline{x}$. It is crucial how efficiently $\underline{x}$ is to be quantized.

The quantization error energy E is defined by $$E = \left\| W\{H\underline{x} - Hgl((s_{0i} + s_{1j})\}\right\|^2 = \left\| WH\{\underline{x} - \{\underline{x} - g_l(s_{0i} + s_{1j})\}\right\|^2 \tag{21}$$

where H denotes characteristics on the frequency axis of the LPC synthesis filter and W a matrix for weighting for representing characteristics for perceptual weighting on the frequency axis.

If the α-parameter by the results of LPC analyses of the current frame is denoted as $\alpha_i$ (1≦i≦P), the values of the L-dimension, for example, 44-dimension corresponding points, are sampled from the frequency response of the equation (22):

$$H(z) = \frac{1}{1 + \sum_{i=1}^{P} \alpha_i z^{-i}} \tag{22}$$

For calculations, 0s are stuffed next to a string of 1, $\alpha_1$, $\alpha_2$, . . . $\alpha_p$ to give a string of 1, $\alpha_1$, $\alpha_2$, . . . $\alpha_p$, 0, 0, . . . , 0 to give e.g., 256-point data. Then, by 256-point FFT, $(r^2+im^2)^{1/2}$ are calculated for points associated with a range from 0 to π and the reciprocals of the results are found. These reciprocals are sub-sampled to L points, such as 44 points, and a matrix is formed having these L points as diagonal elements:

$$H = \begin{bmatrix} h(1) & & & 0 \\ & h(2) & & \\ & & \ddots & \\ 0 & & & h(L) \end{bmatrix}$$

A perceptually weighted matrix W is given by the equation (23):

$$W(z) = \frac{1 + \sum_{i=1}^{P} \alpha_i \lambda_b^i z^{-i}}{1 + \sum_{i=1}^{P} \alpha_i \lambda_a^i z^{-i}} \tag{23}$$

where $\alpha_i$ is the result of the LPC analysis, and λa, λb are constants, such that λa=0.4 and λb=0.9.

The matrix W may be calculated from the frequency response of the above equation (23). For example, FFT is executed on 256-point data of 1, α1λb, α2λ1$b^2$, . . . αpλ$b^p$, 0, 0, . . . , 0 to find $(r_e^2[i]+Im^2[i])^{1/2}$ for a domain from 0 to π, where 0≦i≦128. The frequency response of the denominator is found by 256-point FFT for a domain from 0 to X for 1, α1λa, α2λ$a^2$, . . . , αpλ$a^p$, 0, 0, . . . , 0 at 128 points to find $(re'^2[i]+im'^2[i])^{1/2}$, where 0≦i≦128. The frequency response of the equation 23 may be found by $$w_0[i] = \frac{\sqrt{re^2[i] + im^2[i]}}{\sqrt{re'^2[i] + im'^2[i]}}$$

where 0≦i≦128. This is found for each associated point of, for example, the 44-dimensional vector, by the following method. More precisely, linear interpolation should be used. However, in the following example, the closest point is used instead.

That is, $$\omega[i]=\omega 0\ [\mathrm{nint}(128i/L)],\ \text{where } 1 \leqq i \leqq L.$$

In the equation nint(X) is a function which returns a value closest to X.

As for H, h(1), h(2), . . . h(L) are found by a similar method. That is, $$H = \begin{bmatrix} h(1) & & & 0 \\ & h(2) & & \\ & & \ddots & \\ 0 & & & h(L) \end{bmatrix} W = \begin{bmatrix} w(1) & & & 0 \\ & w(2) & & \\ & & \ddots & \\ 0 & & & w(L) \end{bmatrix} \tag{24}$$

$$WH = \begin{bmatrix} h(1)w(1) & & & 0 \\ & h(2)w(2) & & \\ & & \ddots & \\ 0 & & & h(L)w(L) \end{bmatrix}$$

As another example, H(z)W(z) is first found and the frequency response is then found for decreasing the number of times of FFT. That is, the denominator of the equation (25):

$$H(z)W(z) = \frac{1}{1 + \sum_{i=1}^{P} \alpha_i z^{-i}} \cdot \frac{1 + \sum_{i=1}^{P} \alpha_i \lambda_b^i z^{-i}}{1 + \sum_{i=1}^{P} \alpha_i \lambda_a^i z^{-i}} \tag{25}$$

is expanded to $$\left(1 + \sum_{i=1}^{P} \alpha_i z^{-i}\right)\left(1 + \sum_{i=1}^{P} \alpha_a^i \lambda_a^i z^{-i}\right) = 1 \sum_{i=1}^{2P} \beta_i z^{-i}$$

256-point data, for example, is produced by using a string of 1, $\beta_1$, $\beta_2$, . . . , $\beta_{2p}$, 0, 0, . . . , 0. Then, 256-point FFT is executed, with the frequency response of the amplitude being $$rms[i]=\sqrt{re''^2[i]+im''^2[i]}$$

where 0≦i≦128. From this, $$wh_0[i] = \frac{\sqrt{re^2[i] + im^2[i]}}{\sqrt{re''^2[i] + im''^2[i]}}$$

where 0≦i≦128. This is found for each of corresponding points of the L-dimensional vector. If the number of points of the FFT is small, linear interpolation should be used. However, the closest value is herein is found by:

$$wh[i] = wh_0\left[n\ \mathrm{int}\left(\frac{128}{L}\cdot i\right)\right]$$

where 1≦i≦L. If a matrix having these as diagonal elements is W', $$W' = \begin{bmatrix} wh(1) & & & 0 \\ & wh(2) & & \\ & & \ddots & \\ 0 & & & wh(L) \end{bmatrix} \tag{26}$$

The equation (26) is the same matrix as the above equation (24).

Alternatively, |H(exp(jω))W(exp(jω))| may be directly calculated from the equation (25) with respect to ω≡iπ, where 1≦i≦É, so as to be used for wh[i].

Alternatively, a suitable length, such as 40 points, of an impulse response of the equation (25) may be found and FFTed to find the frequency response of the amplitude which is employed.

The method for reducing the volume of processing in calculating characteristics of a perceptual weighting filter and an LPC synthesis filter is explained.

H(z)W(z) in the equation (25) is Q(z), that is, $$Q(z) = H(z)W(z) = \frac{1}{1 + \sum_{i=1}^{P} \alpha_i z^{-i}} * \frac{1 + \sum_{i=1}^{P} \alpha_i \lambda_b^i z^{-i}}{1 + \sum_{i=1}^{P} \alpha_i \lambda_a^i z^{-i}} \tag{a1}$$

in order to find the impulse response of Q(z) which is set to q(n), with $0 \leqq n < L_{imp}$, where $L_{imp}$ is an impulse response length and, for example, $L_{imp}=40$.

In the present embodiment, since P=10, the equation (a1) represents a 20-order infinite impulse response (IIR) filter having 30 coefficients. By approximately $L_{imp}\times 3P=1200$ sum-of-product operations, $L_{imp}$ samples of the impulse response q(n) of the equation (a1) may be found. By stuffing 0s in q(n), q'(n), where $0 \leqq n \leqq 2^m$, is produced. If, for example, m=7, $2^m - L_{imp}=128-40=88$ 0s are appended to q(n) (0-stuffing) to provide q'(n).

This q'(n) is FFTed at $2^m$ (=128 points). The real and imaginary parts of the result of FFT are re[i] and im[i], respectively, where $0 \leqq is \leqq 2^{m-1}$. From this, $$rm[i]=\sqrt{re^2[i]+im^2[i]} \tag{a2}$$

This is the amplitude frequency response of Q(z), represented by $2^{m-1}$ points. By linear interpolation of neighboring values of rm[i], the frequency response is represented by $2^m$ points. Although higher order interpolation may be used in place of linear interpolation, the processing volume is correspondingly increased. If an array obtained by such interpolation is wlpc[i], where $0 \leqq i \leqq 2^m$, $$wplpc[2i]=rm[i], \text{ where } 0 \leqq i \leqq 2^{m-1} \tag{a3}$$

$$wlpc[2i+1]=(rm[i]+rm[i+1])/2, \text{ where } 0 \leqq i \leqq 2^{m-1} \tag{a4}$$

This gives wlpc[i], where $0 \leqq i \leqq 2^{m-1}$.

From this, wh[i] may be derived by $$wh[i]=wlpc\ [n\mathrm{int}(1281i/L)], \text{ where } 1 \leqq i \leqq É \tag{a5}$$

where nint(x) is a function which returns an integer closest to x. The indicates that, by executing one 128-point FFT operation, W' of the equation (26) may be found by executing one 128-point FFT operation.

The processing volume required for N-point FFT is generally. $(N/2)\log_2 N$ complex multiplication and $N\log_2 N$ complex addition, which is equivalent to $(N/2)\log_2 N\times 4$ real-number multiplication and $N\log_2 N\times 2$ real-number addition.

By such method, the volume of the sum-of-product operations for finding the above impulse response q(n) is 1200. On the other hand, the processing volume of FFT for N $2^7=128$ is approximately 128/2×7×4=1792 and 128×7×2=1792. If the number of the sum-of-product is one, the processing volume is approximately 1792. As for the processing for the equation (a2), the square sum operation, the processing volume of which is approximately 3, and the square root operation, the processing volume of which is approximately 50, are executed $2^{m-1}=2^6=64$ times, so that the processing volume for the equation (a2) is $$64\times(3+50)=3392.$$

On the other hand, the interpolation of the equation (a4) is on the order of 64×2=128.

Thus, in sum total, the processing volume is equal to 1200+1792+3392=128=6512.

Since the weight matrix W is used in a pattern of $W'^T W$, only $rm^2[i]$ may be found and used without executing the processing for square root. In this case, the above equations (a3) and (a4) are executed for $rm^2[i]$ instead of for rm[i], while it is not wh[i] but $wh^2[i]$ that is found by the above equation (a5). The processing volume for finding $rm^2[i]$ in this case is 192, so that, in sum total, the processing volume becomes equal to $$1200+1792+192+128=3312.$$

If the processing from the equation (25) to the equation (26) is executed directly, the sum total of the processing volume is on the order of approximately 12160. That is, 256-point FFT is executed for both the numerator and the denominator of the equation (25). This 256-point FFT is on the order of 256/2×8×4=4096. On the other hand, the processing for $wh_0[i]$ involves two square sum operations, each having the processing volume of 3, division having the processing volume of approximately 25 and square sum operations, with the processing volume of approximately 50. If the square root calculations are omitted in a manner as described above, the processing volume is on the order of 128×(3+3+25)=3968. Thus, in sum total, the processing volume is equal to 4096×2+3968=12160.

Thus, if the above equation (25) is directly calculated to find $wh_0^2[i]$ in place of $wh_0[i]$, the processing volume of the order of 12160 is required, whereas, if the calculations from the equations (a1) to a(5) are executed, the processing volume is reduced to approximately 3312, meaning that the processing volume may be reduced to one-fourth. The weight calculation procedure with the reduced processing volume may be summarized as shown in a flowchart of FIG. 9.

Figure 9:
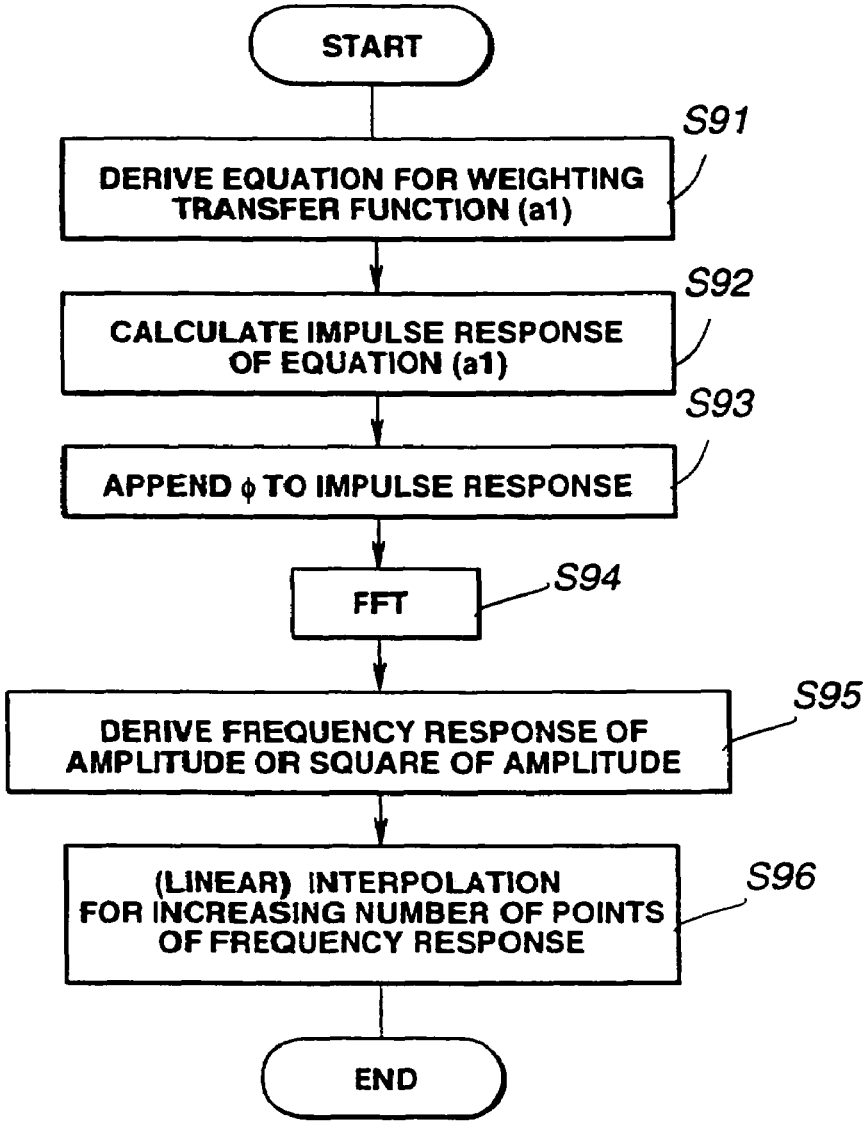
FIG. 9 is a flowchart for illustrating the example of a processing sequence for calculating the weight used for vector quantization.

Referring to FIG. 9, the above equation (a1) of the weight transfer function is derived at the first step S91 and, at the next step S92, the impulse response of (a1) is derived. After 0-appending (0 stuffing) to this impulse response at step S93, FFT is executed at step S94. If the impulse response of a length equal to a power of 2 is derived, FFT can be executed directly without 0 stuffing. At the next step S95, the frequency characteristics of the amplitude or the square of the amplitude are found. At the next step S96, linear interpolation is executed for increasing the number of points of the frequency characteristics.

These calculations for finding the weighted vector quantization can be applied not only to speech encoding but also to encoding of audible signals, such as audio signals. That is, in audible signal encoding in which the speech or audio signal is represented by DFT coefficients, DCT coefficients or MDCT coefficients, as frequency-domain parameters, or parameters derived from these parameters, such as amplitudes of harmonics or amplitudes of harmonics of LPC residuals. The parameters may be quantized by weighted vector quantization by FFTing the impulse response of the weight transfer function or the impulse response interrupted partway and stuffed with 0s and calculating the weight based on the results of the FFT. It is preferred in this case that, after FFTing the weight impulse response, the FFT coefficients themselves, (re, im) where re and im represent real and imaginary parts of the coefficients, respectively, $re^2+im^2$ or $(re^2+im^2)^{1/2}$, be interpolated and used as the weight.

If the equation (21) is rewritten using the matrix W' of the above equation (26), that is, the frequency response of the weighted synthesis filter, we obtain:

$$E=\|W_k'(\underline{x}-g_k(s_{0c}+s_{1k}))\|^2$$

The method for learning the shape codebook and the gain codebook is now further explained.

The expected value of the distortion is minimized for all frames k for which a code vector $\mathbf{s0}_c$ is selected for CB0. If there are M such frames, it suffices if $$J=\frac{1}{M}\sum_{k=1}^{M}\|W_k'(\underline{x}-g_k(s_{0c}+s_{ik}))\|^2 \tag{28}$$

is minimized. In the equation (28), $W_k'$, $\underline{X}_k$, $g_k$ and $s_{ik}$ denote the weighting for the k'th frame, an input to the k'th frame, the gain of the k'th frame, and an output of the codebook CB0 for the k'th frame, respectively.

For minimizing the equation (28), $$\begin{aligned}J=\frac{1}{M}\sum_{k=1}^{M}\{(\underline{x}_k^T-g_k(\underline{s}_{0c}^T+\underline{s}_{1k}^T))W_k'^TW_k'(\underline{x}_k-g_k(s_{0c}+s_{1k}))\}&=\\ \frac{1}{M}\sum_{k=1}^{M}\{\underline{x}_k^TW_k'^TW_k'\underline{x}_k-2g_k(\underline{s}_{0c}^T+\underline{s}_{1k}^T)W_k'^TW_k'\underline{x}_k+&\\ g_k^2(\underline{s}_{0c}^T+\underline{s}_{1k}^T)W_k'^TW_k'(s_{0c}+s_{1k})\}&=\\ \frac{1}{M}\sum_{k=1}^{M}\{\underline{x}_k^TW_k'^TW_k'\underline{x}_k-2g_k(\underline{s}_{oc}^T+\underline{s}_{1k}^T)W_k'^TW_k'\underline{x}_k+&\\ g_k^2\underline{s}_{oc}^TW_k'^TW_k's_{oc}+2g_k^2\underline{s}_{oc}^TW_k'^TW_k's_{1k}+g_k^2\underline{s}_{1k}^TW_k'^TW_k's_{1k}\}&\end{aligned} \tag{29}$$

-continued $$\frac{\partial J}{\partial s_{0c}}=\frac{1}{M}\sum_{k=1}^{M}\{-2g_kW_k'^TW_k'\underline{x}_k+2g_k^2W_k'^TW_k'\underline{s}_{0c}+2g_k^2W_k'^TW_k's_{1k}\}=0 \tag{30}$$

Hence, $$\sum_{k=1}^{M}(g_kW_k'^TW_k'\underline{x}_k-g_k^2W_k'^TW_k'\underline{s}_{lk})=\sum_{k=1}^{M}g^2W_k'^TW_k'\underline{s}_{0c}$$

so that $$s_{0c}=\left\{\sum_{k=1}^{M}g_k^2W_k'^TW_k'\right\}^{-1}\cdot\left\{\sum_{k=1}^{M}g_kW_k'^TW_k'(\underline{x}-g_ks_{lk})\right\} \tag{31}$$

where ( ) denotes an inverse matrix and $W_k'^T$ denotes a transposed matrix of $W_k'$.

Next, gain optimization is considered.

The expected value of the distortion concerning the k'th frame selecting the code word gc of the gain is given by:

$$\begin{aligned}J_g=\frac{1}{M}\sum_{k=1}^{N}\|W_k'(\underline{x}_k-g_c(\underline{s}_{0k}+\underline{s}_{1k}))\|^2&=\\ \frac{1}{M}\sum_{k=1}^{M}\{\underline{x}_k^TW_k'^TW_k'\underline{x}_k-2g_c\underline{x}_k^TW_k'^TW_k'(\underline{s}_{0k}+\underline{s}_{1k})+&\\ g_c^2(\underline{s}_{0k}^T+\underline{s}_{1k}^T)W_k'^TW_k'(\underline{s}_{0k}+\underline{s}_{1k})\}&\end{aligned}$$

Solving $$\frac{\partial J_g}{\partial g_c}=\frac{1}{M}\sum_{k=1}^{M}\{-2\underline{x}_k^TW_k'^TW_k'(\underline{s}_{0k}+\underline{s}_{1k})-2g_c(\underline{s}_{0k}^T+\underline{s}_{1k}^T)W_k'^TW_k'(\underline{s}_{0k}+\underline{s}_{1k})\}=0$$

we obtain $$\sum_{k=1}^{M}\underline{x}_k^TW_k'^TW_k'(\underline{s}_{0k}+\underline{s}_{1k})=\sum_{k=1}^{M}g_c(\underline{s}_{0k}^T+\underline{s}_{1k}^T)W_k'^TW'(\underline{s}_{0k}+\underline{s}_{1k})$$

and $$g_c=\frac{\sum_{k=1}^{M}\underline{x}_k^TW_k'^TW_k'(\underline{s}_{0k}+\underline{s}_{1k})}{\sum_{k=1}^{M}(\underline{s}_{0k}^T+\underline{s}_{1k}^T)W_k'^TW'(\underline{s}_{0k}+\underline{s}_{1k})} \tag{32}$$

The above equations (31) and (32) give optimum centroid conditions for the shape $s_{0i}$, $s_{1i}$, and the gain $g_i$ for $0\leqq i\leqq 31$, $0 \leqq j \leqq 31$ and $0 \leqq l \leqq 31$, that is an optimum decoder output. Meanwhile, $s_{1i}$ may be found in the same way as for $s_{0i}$.

The optimum encoding condition, that is the nearest neighbor condition, is considered.

The above equation (27) for finding the distortion measure, that is $s_{0i}$ and $s_{1i}$ minimizing the equation $E=\|W'(X-g\mathbf{1}(s_{1i}+s_{1j}))\|^2$, are found each time the input $\underline{x}$ and the weight matrix W' are given, that is, on the frame-by-frame basis.

Intrinsically, E is found on the round robin fashion for all combinations of gl ($0 \leqq l \leqq 31$), $s_{0i}$ ($0 \leqq i \leqq 31$) and $s_{0j}$ ($0 \leqq j \leqq 31$), that is $32 \times 32 \times 32 = 32768$, in order to find the set of $s_{0i}$, $s_{1i}$ which will give the minimum value of E. Since this requires extensive calculations, however, the shape and the gain are sequentially searched in the present embodiment. Meanwhile, round robin search is used for the combination of $s_{0i}$ and $s_{1i}$. There are $32 \times 32 = 1024$ combinations for $s_{0i}$ and $s_{1i}$. In the following description, $s_{1i}+s_{1j}$ are indicated as $s_m$ for simplicity.

The above equation (27) becomes $E=\|W'(x-glsm)\|^2$. If, for further simplicity, $\underline{x}_w=W'\underline{x}$ and $s_w=W's_m'$, we obtain $$E=\|\underline{x}_w-g_l s_w\|^2 \tag{33}$$

$$E = \|x_w\|^2 + \|s_w\|^2\left(g_l - \frac{x_w^T \cdot s_w}{\|s_w\|^2}\right)^2 - \frac{\left\langle x_W^T \cdot s_x\right\rangle^2}{\|s_w\|^2} \tag{34}$$

Therefore, if gl can be made sufficiently accurate, a search can be performed in two steps of (1) searching for SW which will maximize $$\frac{(x_w^T \cdot s_w)^2}{\|s_w\|^2}$$

and (2) searching for $g_l$ which is closest to $$\frac{x_w^T \cdot s_w}{\|s_w\|^2}$$

If the above is rewritten using the original notation, (1)' searching is made for a set of $s_{0i}$ and $s_{1i}$ which will maximize $$\frac{\left\langle \underline{x}^T W'^T W'(\underline{s}_{0i} + \underline{s}_{1j})\right\rangle^2}{\|W'(\underline{s}_{0i} + \underline{s}_{1j})\|^2}$$

and (2)' searching is made for $g_l$ which is closest to $$\frac{\underline{x}^T W'^T W'(\underline{s}_{0i} + \underline{s}_{1j})}{\|W'(\underline{s}_{0i} + \underline{s}_{1j})\|^2} \tag{35}$$

The above equation (35) represents an optimum encoding condition (nearest neighbor condition).

Using the conditions (centroid conditions) of the equations (31) and (32) and the condition of the equation (35), codebooks (CB0, CB1 and CBg) can be trained simultaneously with the use of the so-called generalized Lloyd algorithm (GLA).

In the present embodiment, W' divided by a norm of an input x is used as W'. That is, $W'/\|x\|$ is substituted for W' in the equations (31), (32) and (35).

Alternatively, the weighting W', used for perceptual weighting at the time of vector quantization by the vector quantizer 116, is defined by the above equation (26). However, the weighting W' taking into account the temporal masking can also be found by finding the current weighting W' in which past W' has been taken into account.

The values of wh(1), wh(2), . . . , wh(L) in the above equation (26), as found at the time n, that is, at the n'th frame, are indicated as whn(1), whn(2), . . . , whn(L), respectively.

If the weights at time n, taking past values into account, are defined as An(i), where $1 \leqq i \leqq L$, $$\begin{aligned} An(i) &= \lambda A_{n-1}(i) + (1-\lambda)whn(i),\ (whn(i) \le A_{n-1}(i)) \\ &= whn(i),\ (whn(i) > A_{n-1}(i)) \end{aligned}$$

where λ may be set to, for example, λ=0.2. In An(i), with $1 \leqq i \leqq L$, thus found, a matrix having such An(i) as diagonal elements may be used as the above weighting.

The shape index values $s_{0i}$, $s_{1j}$, obtained by the weighted vector quantization in this manner, are output at output terminals 520, 522, respectively, of FIG. 8, while the gain index gl is output at an output terminal 521. Also, the quantized value $x_0'$ is output at the output terminal 504, while being sent to the adder 505.

The adder 505 subtracts the quantized value from the spectral envelope vector x to generate a quantization error vector y. Specifically, this quantization error vector y is sent to the vector quantization unit 511 so as to be dimensionally split and quantized by vector quantizers $\mathbf{511}_1$ to $\mathbf{511}_8$ with weighted vector quantization. The second vector quantization unit 510 uses a larger number of bits than the first vector quantization unit 500. Consequently, the memory capacity of the codebook and the processing volume (complexity) for codebook searching are increased significantly. Thus, it becomes nearly impossible to carry out vector quantization with the 44-dimension which is the same as that of the first vector quantization unit 500. Therefore, the vector quantization unit 511 in the second vector quantization unit 510 is made up of plural vector quantizers and the input quantized values are dimensionally split into plural low-dimensional vectors for performing weighted vector quantization.

The relation between the quantized values $y_0$ to $y_7$, used in the vector quantizers $\mathbf{511}_1$ to $\mathbf{511}_8$, the number of dimensions, and the number of bits are shown in the following Table 2.

TABLE 2

| quantized value | dimension | number of bits |
|---|---|---|
| $y_0$ | 4 | 10 |
| $y_1$ | 4 | 10 |
| $y_2$ | 4 | 10 |
| $y_3$ | 4 | 10 |
| $y_4$ | 4 | 9 |

TABLE 2-continued

| quantized value | dimension | number of bits |
|---|---|---|
| $y_5$ | 8 | 8 |
| $y_6$ | 8 | 8 |
| $y_7$ | 8 | 7 |

The index values $Id_{vq0}$ to $Id_{vq7}$ output from the vector quantizers 511$_1$ to 511$_8$ are output at output terminals 523$_1$ to 523$_8$. The sum of bits of these index data is 72.

If a value obtained by connecting the output quantized values $y_0'$ to $y_7'$ of the vector quantizers 511$_1$ to 511$_8$ in the dimensional direction is y', the quantized values y' and $x_0'$ are summed by the adder 513 to give a quantized value $x_1'$. Therefore, the quantized value $x_1'$ is represented by $$\begin{aligned} \underline{x}_1' &= \underline{x}_0' + \underline{y}' \\ &= \underline{x} - \underline{y} + \underline{y}' \end{aligned}$$

That is, the ultimate quantization error vector is y'-y.

If the quantized value $x_1'$ from the second vector quantizer 510 is to be decoded, the speech signal decoding apparatus is not in need of the quantized value $x_1'$ from the first quantization unit 500. It is, however, in need of index data from the first quantization unit 500 and the second quantization unit 510.

The learning method and code book search in the vector quantization section 511 will now be further explained.

As for the learning method, the quantization error vector y is divided into eight low-dimension vectors $y_0$ to $y_7$, using the weight W', as shown in Table 2. If the weight W' is a matrix having 44-point sub-sampled values as diagonal elements:

$$W' = \begin{bmatrix} wh(1) & & & 0 \\ & wh(2) & & \\ & & \ddots & \\ 0 & & & wh(44) \end{bmatrix} \tag{36}$$

the weight W' is split into the following eight matrices:

$$W_1' = \begin{bmatrix} wh(1) & & 0 \\ & \ddots & \\ 0 & & wh(4) \end{bmatrix}$$

$$W_2' = \begin{bmatrix} wh(5) & & 0 \\ & \ddots & \\ 0 & & wh(8) \end{bmatrix}$$

$$W_3' = \begin{bmatrix} wh(9) & & 0 \\ & \ddots & \\ 0 & & wh(12) \end{bmatrix}$$

$$W_4' = \begin{bmatrix} wh(13) & & 0 \\ & \ddots & \\ 0 & & wh(16) \end{bmatrix}$$

$$W_5' = \begin{bmatrix} wh(17) & & 0 \\ & \ddots & \\ 0 & & wh(20) \end{bmatrix}$$

-continued $$W_6' = \begin{bmatrix} wh(21) & & 0 \\ & \ddots & \\ 0 & & wh(28) \end{bmatrix}$$

$$W_7' = \begin{bmatrix} wh(29) & & 0 \\ & \ddots & \\ 0 & & wh(36) \end{bmatrix}$$

$$W_8' = \begin{bmatrix} wh(37) & & 0 \\ & \ddots & \\ 0 & & wh(44) \end{bmatrix}$$

y and W', thus split in low dimensions, are termed $Y_i$ and $W_i'$, where $1 \leqq i \leqq 8$, respectively.

The distortion measure E is defined as $$E = \|W_i'(y_i - s)\|^2 \tag{37}$$

The codebook vector s is the result of quantization of $y_i$. Such code vector of the codebook minimizing the distortion measure E is searched.

In the codebook learning, further weighting is performed using the general Lloyd algorithm (GLA). The optimum centroid condition for learning is first explained. If there are M input vectors y which have selected the code vector s as optimum quantization results, and the training data is $y_k$, the expected value of distortion J is given by the equation (38) minimizing the center of distortion on weighting with respect to all frames k:

$$\begin{aligned} J &= \frac{1}{M}\sum_{k=1}^{M} \|W_k'(\underline{y}_k - \underline{s})\|^2 \\ &= \frac{1}{M}\sum_{k=1}^{M} (\underline{y}_k - \underline{s})^T W_k'^T W_k'(\underline{y}_k - \underline{s}) \\ &= \frac{1}{M}\sum_{k=1}^{M} \underline{y}_k^T W_k'^T W_k' \underline{y}_k - 2\underline{y}_k^T W_k'^T W_k' \underline{s} + \underline{s}^T W_k'^T W_k' \underline{s} \end{aligned}$$

Solving $$\frac{\partial J}{\partial \underline{s}} = \frac{1}{M}\sum_{k=1}^{M} \left(-2\underline{y}_k^T W_k'^T W_k' + 2\underline{s}^T W_k'^T W_k'\right) = 0$$

we obtain $$\sum_{k=1}^{M} \underline{y}_k^T W_k'^T W_k' = \sum_{k=1}^{M} \underline{s}^T W_k'^T W_k'$$

Taking transposed values of both sides, we obtain $$\sum_{k=1}^{M} W_k'^T W_k' \underline{y}_k = \sum_{k=1}^{M} W_k'^T W_k' \underline{s}$$

Therefore, $$\underline{s} = \left(\sum_{k=1}^{M} W_k'^T W_k'\right)^{-1} \sum_{k=1}^{M} W_k'^T W_k' \underline{y}_k \tag{39}$$

In the above equation (39), s is an optimum representative vector and represents an optimum centroid condition.

As for the optimum encoding condition, it suffices to search for s minimizing the value of $\|W_i'(y_i-s)\|^2 \cdot W_i'$ during searching need not be the same as $W_i'$ during learning and may be non-weighted matrix:

$$\begin{bmatrix} 1 & & 0 \\ & 1 & \\ & \ddots & \\ 0 & & 1 \end{bmatrix}$$

By constructing the vector quantization unit 116 in the speech signal encoder using two-stage vector quantization units, it becomes possible to render the number of output index bits variable.

Figure 10:
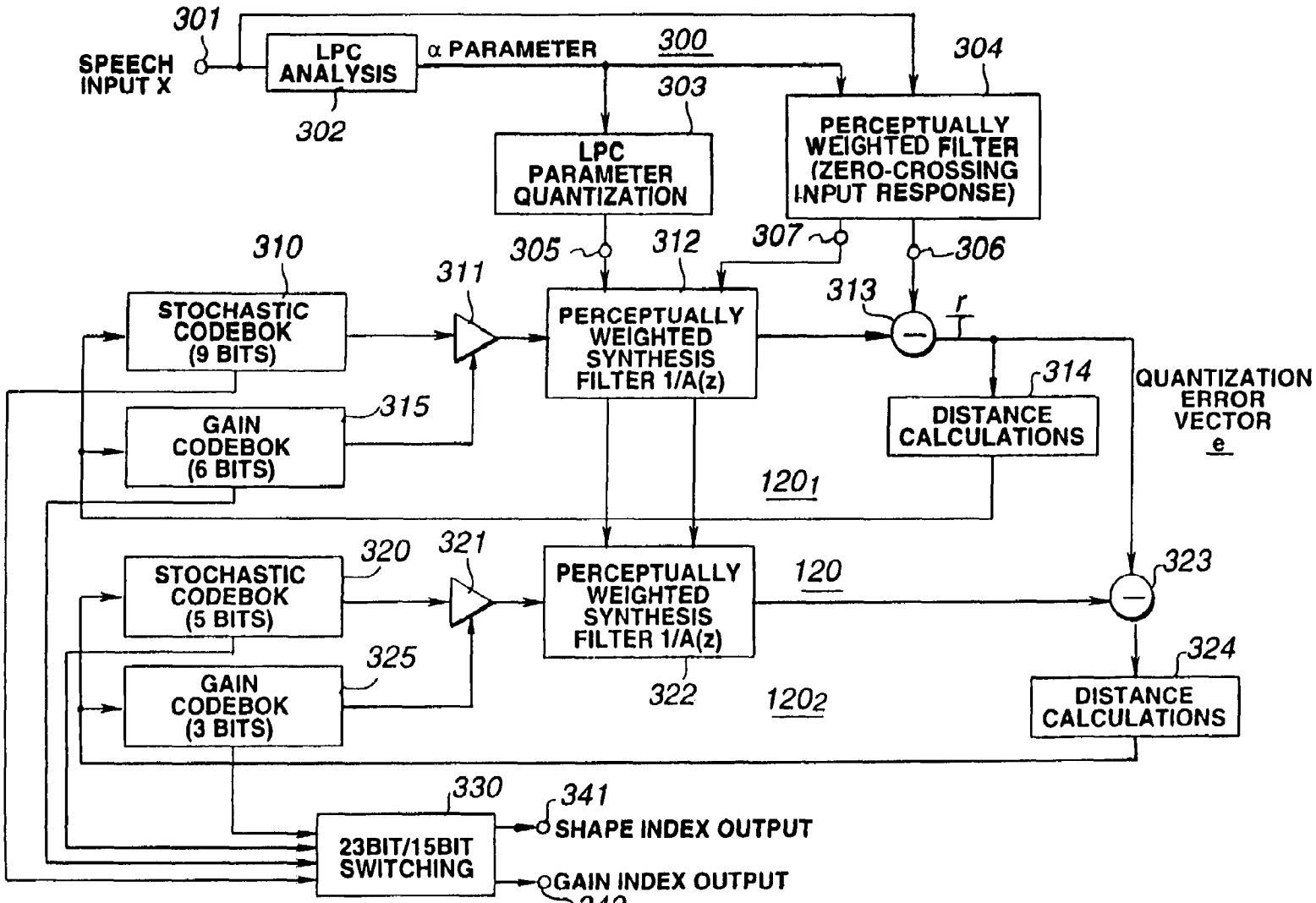
FIG. 10 is a block circuit diagram showing the structure of a CELP coding part (second encoding part) of the speech signal encoder according to the present invention.

The second encoding unit 120 employing the above-mentioned CELP encoder is comprised of multi-stage vector quantization processors as shown in FIG. 10. These multi-stage vector quantization processors are formed as two-stage encoding units $\mathbf{120}_1$, $\mathbf{120}_2$ in the embodiment of FIG. 10, in which an arrangement for coping with the transmission bit rate of 6 kbps and a transmission bit rate of 2 kbps is shown. In addition, the shape and gain index output can be switched between 23 bits/5 msec and 15 bits/5 msec. The processing flow in the arrangement of FIG. 10 is shown in FIG. 11.

Referring to FIG. 10, an LPC analysis circuit 302 corresponds to the LPC analysis circuit 132 shown in FIG. 3, an LSP parameter quantization circuit 303 corresponds to the α to LSP conversion circuit 133 and the LSP to α conversion circuit 137 of FIG. 3, and a perceptually weighted filter 304 of FIG. 10 corresponds to the perceptual weighting filter calculation circuit 139 and the perceptually weighted filter 125 of FIG. 3. Therefore, in FIG. 10, an output which is the same as that of the LSP to α conversion circuit 137 of the first encoding unit 113 of FIG. 3 is supplied to a terminal 305, while an output which is the same as the output of the perceptually weighted filter calculation circuit 139 of FIG. 3 is supplied to a terminal 307 and an output which is the same as the output of the perceptually weighted filter 125 of FIG. 3 is supplied to a terminal 306. However, in distinction from the perceptually weighted filter 125, the perceptually weighted filter 304 of FIG. 10 generates the perceptually weighed signal, that is, the same signal as the output of the perceptually weighted filter 125 of FIG. 3, using the input speech data and pre-quantization α-parameter, instead of using an output of the LSP-α conversion circuit 137.

In the two-stage second encoding units $\mathbf{120}_1$ and $\mathbf{120}_2$ shown in FIG. 10, subtractors 313 and 323 correspond to the subtractor 123 of FIG. 3, while the distance calculation circuits 314, 324 correspond to the distance calculation circuit 124 of FIG. 3. In addition, the gain circuits 311, 321 correspond to the gain circuit 126 of FIG. 3, while stochastic codebooks 310, 320 and gain codebooks 315, 325 correspond to the noise codebook 121 of FIG. 3.

Figure 11:
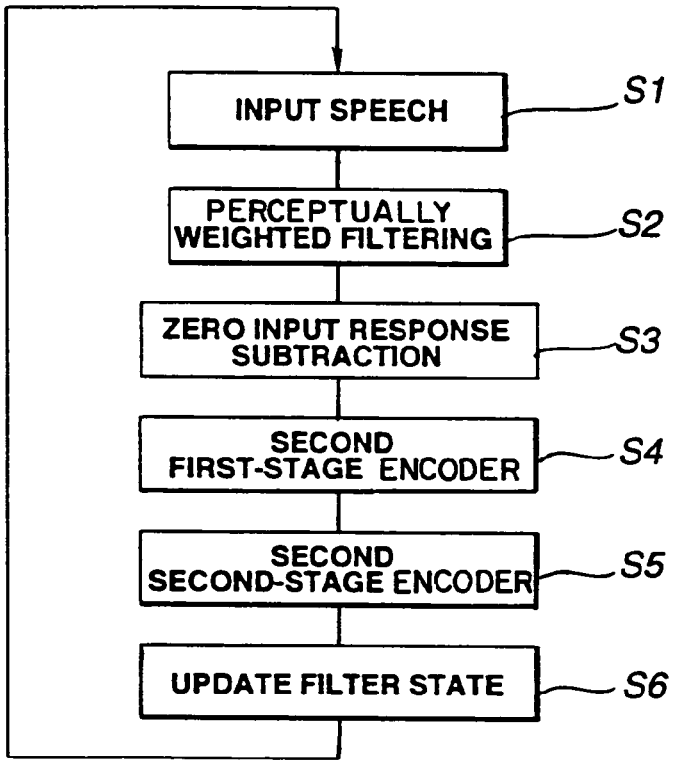
FIG. 11 is a flowchart for illustrating the processing flow in the arrangement of FIG. 10.

In the arrangement of FIG. 10, the LPC analysis circuit 302 at step S1 of FIG. 11 splits input speech data x supplied from a terminal 301 into frames as described above to perform LPC analyses in order to find an α-parameter. The LSP parameter quantization circuit 303 converts the α-parameter from the LPC analysis circuit 302 into LSP parameters to quantize the LSP parameters. The quantized LSP parameters are interpolated and converted into α-parameters. The LSP parameter quantization circuit 303 generates an LPC synthesis filter function 1/H (z) from the α-parameters converted from the quantized LSP parameters, that is, the quantized LSP parameters, and sends the generated LPC synthesis filter function 1/H (z) to a perceptually weighted synthesis filter 312 of the first-stage second encoding unit $\mathbf{120}_1$ via terminal 305.

The perceptual weighting filter 304 finds data for perceptual weighting, which is the same as that produced by the perceptually weighting filter calculation circuit 139 of FIG. 3, from the α-parameter from the LPC analysis circuit 302, that is, pre-quantization α-parameter. These weighting data are supplied via terminal 307 to the perceptually weighting synthesis filter 312 of the first-stage second encoding unit $\mathbf{120}_1$. The perceptual weighting filter 304 generates the perceptually weighted signal, which is the same signal as that output by the perceptually weighted filter 125 of FIG. 3, from the input speech data and the pre-quantization α-parameter, as shown at step S2 in FIG. 11. That is, the LPC synthesis filter function W (z) is first generated from the pre-quantization α-parameter. The filter function W(z) thus generated is applied to the input speech data $\underline{x}$ to generate $\underline{x}w$ which is supplied as the perceptually weighted signal via terminal 306 to the subtractor 313 of the first-stage second encoding unit $\mathbf{120}_1$. In the first-stage second encoding unit $\mathbf{120}_1$, a representative value output of the stochastic codebook 310 of the 9-bit shape index output is sent to the gain circuit 311 which then multiplies the representative output from the stochastic codebook 310 with the gain (scalar) from the gain codebook 315 of the 6-bit gain index output. The representative value output, multiplied with the gain by the gain circuit 311, is sent to the perceptually weighted synthesis filter 312 with 1/A(z) =(1/H(z))*W(z). The weighting synthesis filter 312 sends the 1/A(z) zero-input response output to the subtractor 313, as indicated at step S3 of FIG. 11. The subtractor 313 performs subtraction on the zero-input response output of the perceptually weighting synthesis filter 312 and the perceptually weighted signal $\underline{x}w$ from the perceptual weighting filter 304 and the resulting difference or error is taken out as a reference vector r. During searching at the first-stage second encoding unit $\mathbf{120}_1$, this reference vector r is sent to the distance calculating circuit 314 where the distance is calculated and the shape vector s and the gain g minimizing the quantization error energy E are searched, as shown at step S4 in FIG. 11. Here, 1/A(z) is in the zero state. That is, if the shape vector s in the codebook synthesized with 1/A(z) in the zero state is $s_{syn}$, the shape vector s and the gain g minimizing the equation (40):

$$E = \sum_{n=0}^{N-1} (r(n) - g s_{syn}(n))^2 \tag{40}$$

are searched.

Although s and g minimizing the quantization error energy E may be full-searched, the following method may be used for reducing the amount of calculations.

The first method is to search the shape vector s minimizing $E_s$ defined by the following equation (41):

$$E_s = \frac{\sum_{n=0}^{N-1} r(n)s_{syn}(n)}{\sqrt{\sum_{n=0}^{N-1} s_{syn}(n)^2}} \quad (41)$$

From s obtained by the first method, the ideal gain is as shown by the equation (42):

$$g_{ref} = \frac{\sum_{n=0}^{N-1} r(n)s_{syn}(n)}{\sum_{n=0}^{N-1} s_{syn}(n)^2}. \quad (42)$$

Therefore, as the second method, such g minimizing the equation (43):

$$Eg=(g_{ref}-g)^2 \quad (43)$$

is searched.

Since E is a quadratic function of g, such g minimizing Eg minimizes E.

From s and g obtained by the first and second methods, the quantization error vector e can be calculated by the following equation (44):

$$e=r-gs_{syn} \quad (44)$$

This is quantized as a reference of the second-stage second encoding unit 120$_2$ as in the first stage.

That is, the signal supplied to the terminals 305 and 307 are directly supplied from the perceptually weighted synthesis filter 312 of the first-stage second encoding unit 120$_1$ to a perceptually weighted synthesis filter 322 of the second stage second encoding unit 120$_2$. The quantization error vector e found by the first-stage second encoding unit 120$_1$ is supplied to a subtractor 323 of the second-stage second encoding unit 120$_2$.

At step S5 of FIG. 11, processing similar to that performed in the first stage occurs in the second-stage second encoding unit 120$_2$. That is, a representative value output from the stochastic codebook 320 of the 5-bit shape index output is sent to the gain circuit 321 where the representative value output of the codebook 320 is multiplied with the gain from the gain codebook 325 of the 3-bit gain index output. An output of the weighted synthesis filter 322 is sent to the subtractor 323 where a difference between the output of the perceptually weighted synthesis filter 322 and the first-stage quantization error vector e is found. This difference is sent to a distance calculation circuit 324 for distance calculation in order to search the shape vector s and the gain g minimizing the quantization error energy E.

The shape index output of the stochastic codebook 310 and the gain index output of the gain codebook 315 of the first-stage second encoding unit 120$_1$ and the index output of the stochastic codebook 320 and the index output of the gain codebook 325 of the second-stage second encoding unit 120$_2$ are sent to an index output switching circuit 330. If 23 bits are outputted from the second encoding unit 120, the index data of the stochastic codebooks 310, 320 and the gain codebooks 315, 325 of the first-stage and second-stage second encoding units 120$_1$, 120$_2$ are summed and outputted. If 15 bits are outputted, the index data of the stochastic codebook 310 and the gain codebook 315 of the first-stage second encoding unit 120$_1$ are outputted.

The filter state is then updated for calculating zero input response output as shown at step S6.

In the present embodiment, the number of index bits of the second-stage second encoding unit 120$_2$ is as small as 5 for the shape vector, while that for the gain is as small as 3. If suitable shape and gain are not present in this case in the codebook, the quantization error is likely to be increased, instead of being decreased.

Although 0 may be provided in the gain for preventing this problem from occurring, there are only three bits for the gain. If one of these is set to 0, the quantizer performance is significantly deteriorated. In this consideration, an all-0 vector is provided for the shape vector to which a larger number of bits have been allocated. The above-mentioned search is performed, with the exclusion of the all-zero vector, and the all-zero vector is selected if the quantization error has ultimately been increased. The gain is arbitrary. This makes it possible to prevent the quantization error from being increased in the second-stage second encoding unit 120$_2$.

Although the two-stage arrangement has been described above, the number of stages may be larger than 2. In such case, if the vector quantization by the first-stage closed-loop search has come to a close, quantization of the N'th stage, where $2 \leqq N$, is carried out with the quantization error of the (N−1)st stage as a reference input, and the quantization error of the of the N'th stage is used as a reference input to the (N+1)st stage.

It is seen from FIGS. 10 and 11 that, by employing multi-stage vector quantizers for the second encoding unit, the amount of calculations is decreased as compared to that with the use of straight vector quantization with the same number of bits or with the use of a conjugate codebook. In particular, in CELP encoding in which vector quantization of the time-axis waveform employing the closed-loop search by the analysis by synthesis method is performed, a smaller number of times of search operations is crucial. In addition, the number of bits can be easily switched by switching between employing both index outputs of the two-stage second encoding units 120$_1$, 120$_2$ and employing only the output of the first-stage second encoding unit 120$_1$ without employing the output of the second-stage second encoding unit 120$_1$. If the index outputs of the first-stage and second-stage second encoding units 120$_1$, 120$_2$ are combined and output, the decoder can easily cope with the configuration by selecting one of the index outputs. That is, the decoder can easily cope with the configuration by decoding the parameter encoded with e.g., 6 kbps using a decoder operating at 2 kbps. In addition, if a zero-vector is contained in the shape codebook of the second-stage second encoding unit 120$_2$, it becomes possible to prevent the quantization error from being increased with lesser deterioration in performance than if 0 is added to the gain.

The code vector of the stochastic codebook (shape vector) can be generated by, for example, the following method.

The code vector of the stochastic codebook, for example, can be generated by clipping the so-called Gaussian noise. Specifically, the codebook may be generated by generating the Gaussian noise, clipping the Gaussian noise with a suitable threshold value and normalizing the clipped Gaussian noise.

However, there are a variety of types of speech. For example, the Gaussian noise can cope with speech of consonant sounds close to noise, such as “sa, shi, su, se and so”, while the Gaussian noise cannot cope with the speech of acutely rising consonants, such as "pa, pi, pu, pe and po".

Figure 12A:
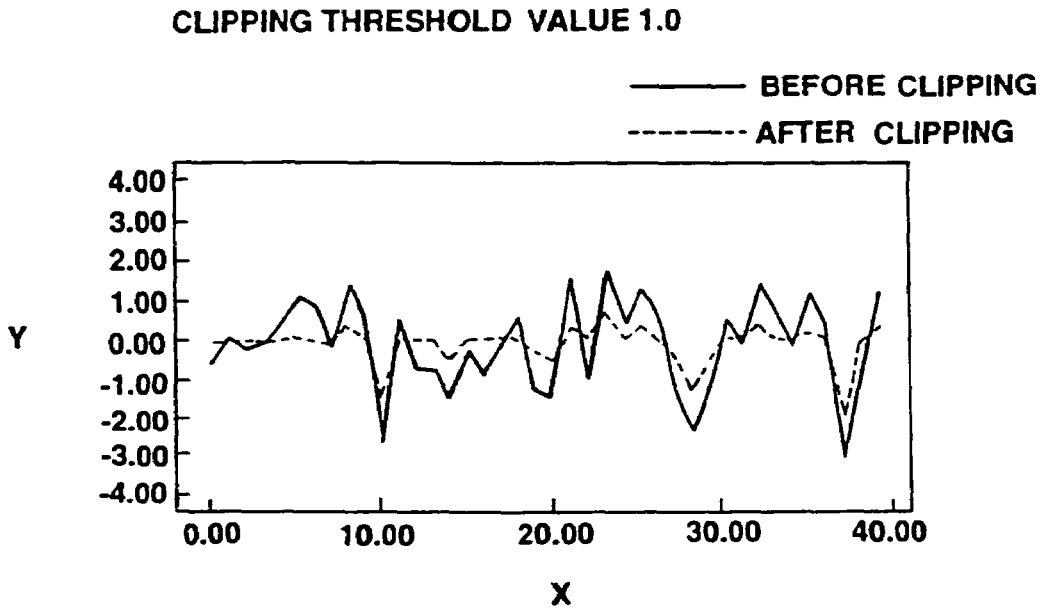
FIG. 12 shows the state of the Gaussian noise and the noise after clipping at different threshold values.
Figure 12B:
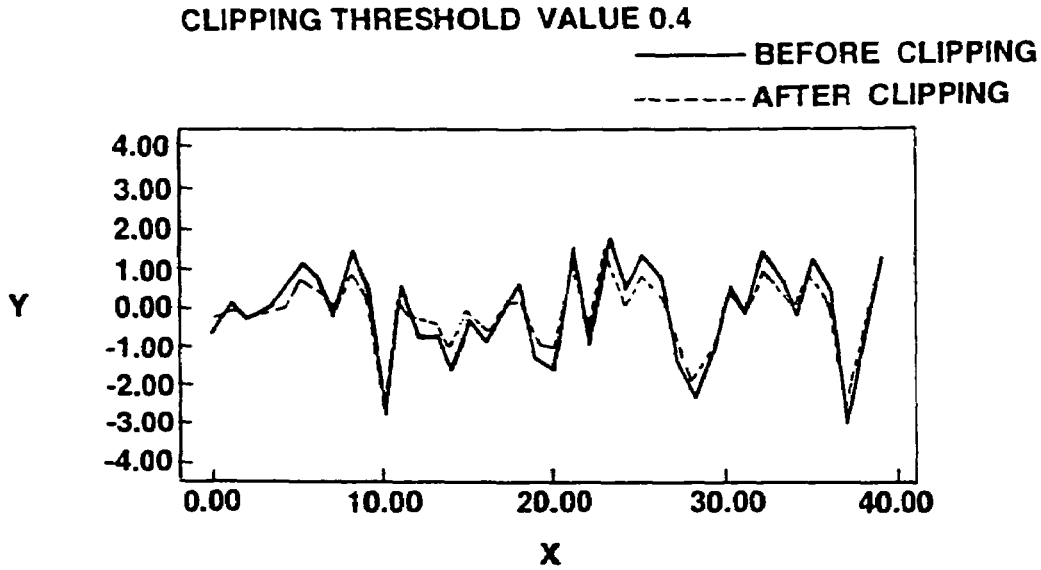

According to the present invention the Gaussian noise is applied to some of the code vectors, while the remaining portion of the code vectors are dealt with by learning, so that both the consonants having sharply rising consonant sounds and the consonant sounds close to the noise can be coped with. If, for example, the threshold value is increased, a vector is obtained which has several larger peaks, whereas, if the threshold value is decreased, the code vector is approximate to the Gaussian noise. Thus, by increasing the variation in the clipping threshold value, it becomes possible to cope with consonants having sharp rising portions, such as "pa, pi, pu, pe and po" or consonants close to noise, such as "sa, shi, su, se and so", thereby increasing clarity. FIG. 12 shows the appearance of the Gaussian noise and the clipped noise by a solid line and by a broken line, respectively. FIGS. 12A and 12B respectively show the noise with the clipping threshold value equal to 1.0, that is with a larger threshold value, and the noise with the clipping threshold value equal to 0.4, that is with a smaller threshold value. It is seen from FIGS. 12A and 12B that, if the threshold value is selected to be larger, there is obtained a vector having several larger peaks, whereas, if the threshold value is selected to a smaller value, the noise approaches to the Gaussian noise itself.

Thus, an initial codebook is prepared by clipping the Gaussian noise and a suitable number of non-learning code vectors are set. The non-learning code vectors are selected in the order of the increasing variance value for coping with consonants close to the noise, such as "sa, shi, su, se and so". The vectors found by learning use the LBG algorithm for learning. The encoding under the nearest neighbor condition uses both the fixed code vector and the code vector obtained on learning. In the centroid condition, only the code vector to be learned is updated. Thus the code vector to be learned can cope with sharply rising consonants, such as "pa, pi, pu, pe and po".

An optimum gain may be learned for these code vectors by a conventional learning process.

Figure 13:
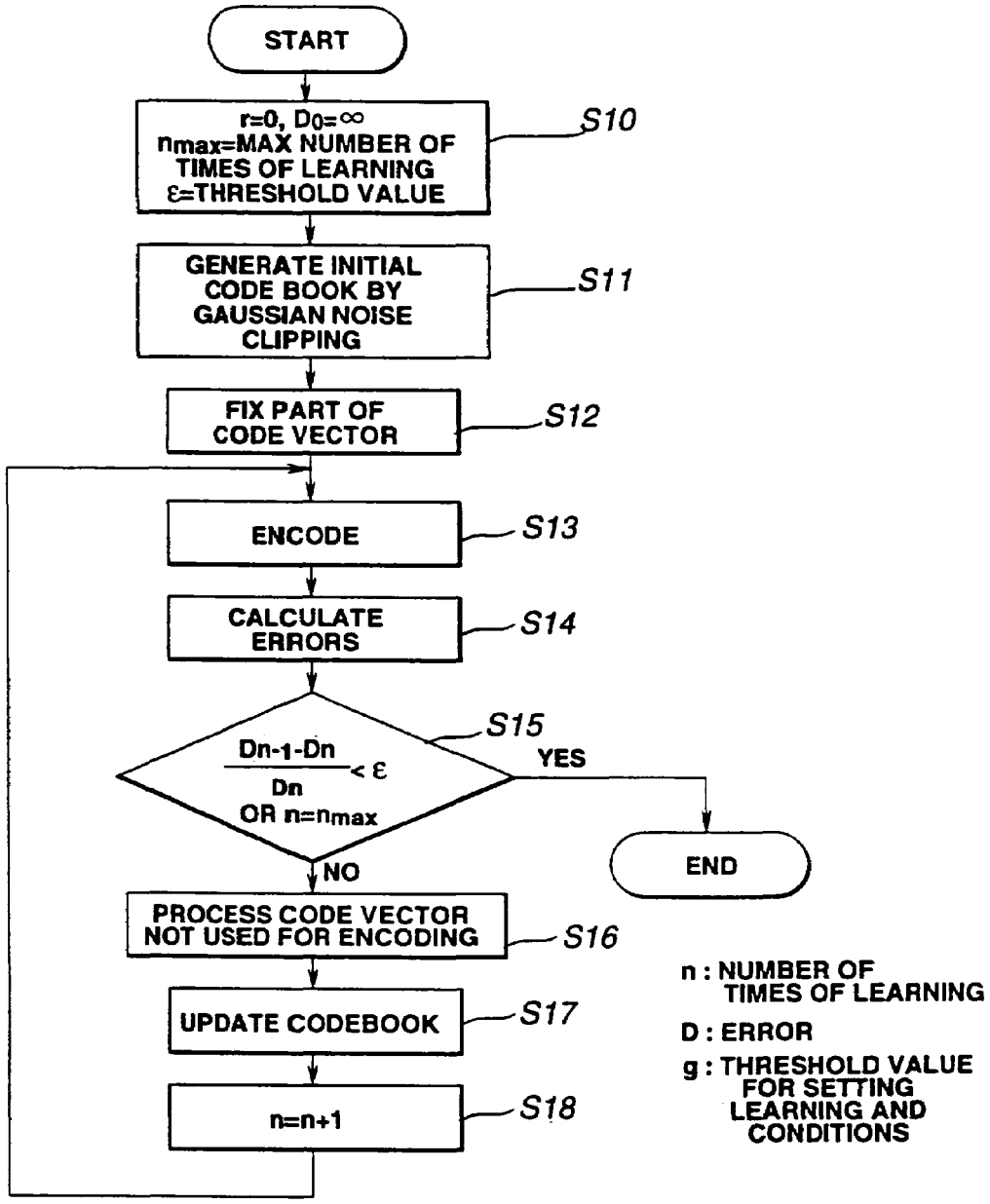
FIG. 13 is a flowchart showing the processing flow at the time of generating a shape codebook by learning.
Figure 14:
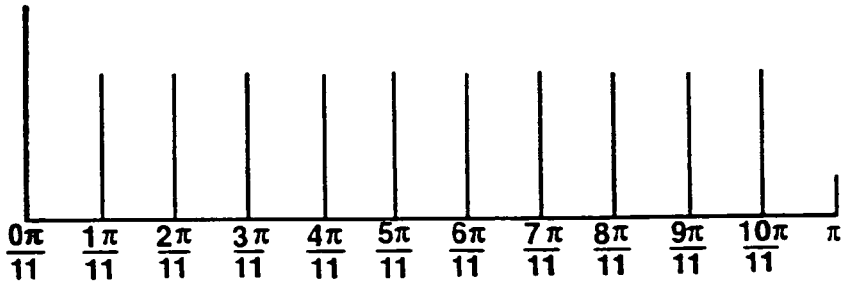
FIG. 14 illustrates 10-order linear spectrum pairs (LSPs) derived from α-parameters obtained by 10-order LPC analysis.

FIG. 13 shows the processing flow for the codebook learning process employing clipping the Gaussian noise.

In FIG. 13 the number of times of learning n is set to n=0 at step S10 for initialization. With an error $D_0=\infty$, the maximum number of times of learning $n_{max}$ is set and a threshold value $\epsilon$ setting the learning end condition is set.

At the next step S11, the initial codebook by clipping the Gaussian noise is generated. At step S12, part of the code vectors are fixed as non-learning code vectors.

At the next step S13, encoding is done using the above codebook. At step S14, the error is calculated. At step S15, it is judged if ($D_{n-1}-D_n/D_n<\epsilon$, or $n=n_{max}$). If the result is YES, processing is terminated. If the result is NO, processing transfers to step S16.

At step S16, the code vectors not used for encoding are processed. At the next step S17, the code books are updated. At step S18, the number of times of learning n is incremented before returning to step S13.

In the speech encoder of FIG. 3, a specified example of a voiced/unvoiced (V/UV) discrimination unit 115 is now further explained.

The V/UV discrimination unit 115 performs V/UV discrimination of a frame under consideration based on an output of the orthogonal transform circuit 145, an optimum pitch from the high precision pitch search unit 146, spectral amplitude data from the spectral evaluation unit 148, a maximum normalized autocorrelation value r(p) from the open-loop pitch search unit 141, and a zero-crossing count value from the zero-crossing counter 142. The boundary position of the band-based results of V/UV decision, similar to that used for MBE, is also used as one of the conditions for the frame under consideration.

The condition for V/UV discrimination for the MBE, employing the results of band-based V/UV discrimination, is now further explained.

The parameter or amplitude $|A_m|$ representing the magnitude of the m'th harmonics in the case of MBE may be represented by $$\therefore |A_m| = \sum_{j=a_m}^{b_m} |S(j)||E(j)| \Big/ \sum_{j=a_m}^{b_m} |E(j)|^2$$

In this equation, |S(j)| is a spectrum obtained on DFTing LPC residuals, and |E(j)| is the spectrum of the basic signal, specifically, a 256-point Hamming window, while $a_m$, $b_m$ are lower and upper limit values, represented by an index j, of the frequency corresponding to the m'th band corresponding in turn to the m'th harmonics. For band-based V/UV discrimination, a noise to signal ratio (NSR) is used. The NSR of the m'th band is represented by $$NSR = \frac{\sum_{j=a_m}^{b_m} (|S(j) - |A_m| \, |E(j)|)^2}{\sum_{j=a_m}^{b_m} |S(j)|^2}$$

If the NSR value is larger than a pre-set threshold, such as 0.3, that is, if an error is larger, it may be judged that approximation of |S(j)| by $|A_m|$ |E(j)| in the band under consideration is not good, that is, that the excitation signal |E(j)| is not appropriate as the base. Thus the band under consideration is determined to be unvoiced (UV). If otherwise, it may be judged that approximation has been done fairly well and hence is determined to be voiced (V).

It is noted that the NSR of the respective bands (harmonics) represent similarity of the harmonics from one harmonics to another. The sum of gain-weighted harmonics of the NSR is defined as $NSR_{all}$ by:

$$NSR_{all}=(\Sigma_m|A_m|NSR_m)/(\Sigma_m|A_m|)$$

The rule base used for V/UV discrimination is determined depending on whether this spectral similarity $NSR_{all}$ is larger or smaller than a certain threshold value. This threshold may be set to $Th_{NSR}=0.3$. This rule base is concerned with the maximum value of the autocorrelation of the LPC residuals, frame power, and the zero-crossing. In the case of the rule base used for $NSR_{all}<Th_{NSR}$, the frame under consideration becomes V and UV if the rule is applied and if there is no applicable rule, respectively.

A specified rule is as follows:

For $NSR_{all}<TH_{NSR}$, if numZero XP<24, formPow>340 and r0>0.32, then the frame under consideration is V;

For $NSR_{all}\geqq TH_{NSR}$,

If numZero XP>30, frmPow<900 and r0>0.23, then the frame under consideration is UV;

wherein respective variables are defined as follows:

numZeroXP: number of zero-crossings per frame formPow: frame power r0: maximum value of auto-correlation The rule representing a set of specified rules such as those given above are consulted for doing V/UV discrimination.

The arrangement of essential portions and the operation of the speech signal decoder of FIG. 4 will now be explained in more detail.

The LPC synthesis filter 214 is separated into the synthesis filter 236 for the voiced speech (V) and into the synthesis filter 237 for the unvoiced speech (UV), as previously explained. If LSPs are continuously interpolated every 20 samples, that is, every 2.5 msec, without separating the synthesis filter and without making V/UV distinction, LSPs of totally different properties are interpolated at V to UV or UV to V transient portions. The result is that LPC of UV and V are used as residuals of V and UV, respectively, such that strange sound tends to be produced. For preventing such ill effects from occurring, the LPC synthesis filter is separated into V and UV and LPC coefficient interpolation is independently performed for V and UV.

The method for coefficient interpolation of the LPC filters 236, 237 in this case is now further explained. Specifically, LSP interpolation is switched depending on the V/UV state, as shown in Table 3.

TABLE 3

| | H(v)z | | Huv(z) | |
|---|---|---|---|---|
| | previous frame | current frame | previous frame | current frame |
| v → v | transmitted LSP | transmitted LSP | equal interval LSP | equal interval LSP |
| v → uv | transmitted LSP | equal interval LSP | equal interval LSP | transmitted LSP |
| uv → v | equal interval LSP | transmitted LSP | transmitted LSP | equal interval LSP |
| uv → uv | equal interval LSP | equal interval LSP | transmitted LSP | transmitted LSP |

Taking an example of the 10-order LPC analysis, the equal interval LSP is such LSP corresponding to α-parameters for flat filter characteristics and the gain equal to unity, that is, $\alpha_0=1$, $\alpha_1=\alpha_2=\ldots=\alpha_{10}=0$, with $0 \leqq \alpha \leqq 10$.

Such 10-order LPC analysis, that is, 10-order LSP, is the LSP corresponding to a completely flat spectrum, with LSPs being arrayed at equal intervals at 11 equally spaced apart positions between 0 and π. In such case, the entire band gain of the synthesis filter has minimum through-characteristics.

Figure 15:
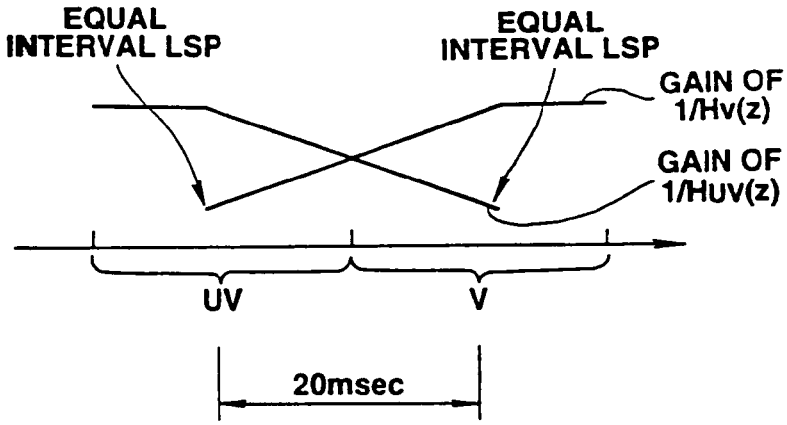
FIG. 15 illustrates the manner of gain change from a UV frame to a V frame.

FIG. 15 schematically shows the manner of gain change. Specifically, FIG. 15 shows how the gain of $1/H_{uv(z)}$ and the gain of $1/H_{v(z)}$ are changed during transition from the unvoiced (UV) portion to the voiced (V) portion.

As for the unit of interpolation, it is 2.5 msec (20 samples) for the coefficient of $1/H_{v(z)}$, while it is 10 msec (80 samples) for the bit rate of 2 kbps and 5 msec (40 samples) for the bit rate of 6 kbps, respectively, for the coefficient of $1/H_{uv(z)}$. For UV, since the second encoding unit 120 performs waveform matching employing an analysis by synthesis method, interpolation with the LSPs of the neighboring V portions may be performed without performing interpolation with the equal interval LSPs. It is noted that, in the encoding of the UV portion in the second encoding portion 120 of FIG. 1, the zero-input response is set to zero by clearing the inner state of the 1/A(z) weighted synthesis filter 122 at the transient portion from V to UV.

Outputs of these LPC synthesis filters 236, 237 are sent to the respective independently provided post-filters **238*v*, 238*u***. The intensity and the frequency response of the post-filters are set to values that are independent and may be different for V and UV for setting the intensity and the frequency response of the post-filters to different values for V and UV.

The windowing of junction portions between the V and the UV portions of the LPC residual signals, that is, the excitation as an LPC synthesis filter input, is now further explained. This windowing is carried out by the sinusoidal synthesis circuit 215 of the voiced speech synthesis unit 211 and by the windowing circuit 223 of the unvoiced speech synthesis unit 220. The method for synthesis of the V-portion of the excitation is explained in detail in JP Patent Application No. 4-91422, assigned to the present Assignee, while the method for fast synthesis of the V-portion of the excitation is explained in detail in JP Patent Application No. 6-198451, similarly assigned to the present Assignee. In the present illustrative embodiment, this method of fast synthesis is used for generating the excitation of the V-portion using this fast synthesis method.

Figure 16:
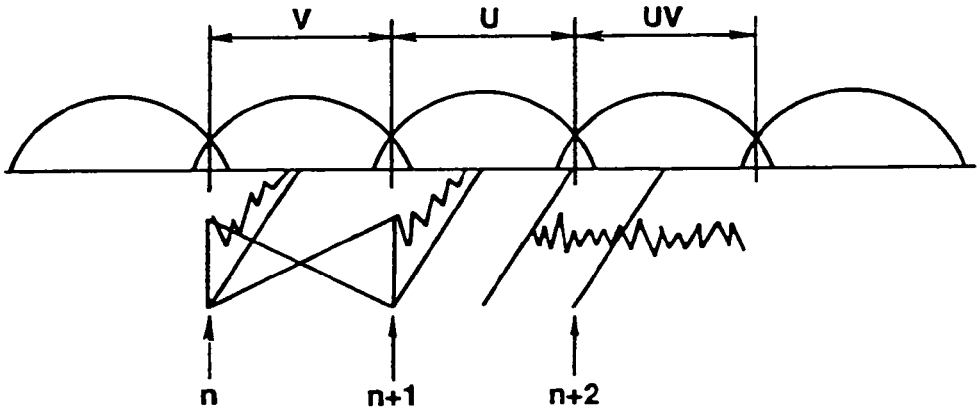
FIG. 16 illustrates the manner of interpolation of the spectrum and the waveform synthesized from frame to frame.
Figure 17:
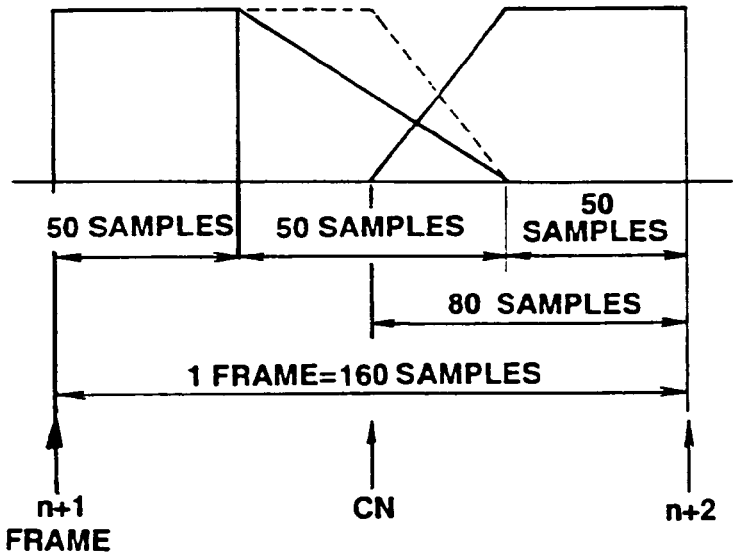
FIG. 17 illustrates the manner of overlap at a junction between the voiced (V) portion and the unvoiced (UV) portion.

In the voiced (V) portion, in which sinusoidal synthesis is performed by interpolation using the spectrum of the neighboring frames, all waveforms between the n'th and (n+1)st frames can be produced. Nevertheless, for the signal portion astride the V and UV portions, such as the (n+1)st frame and the (n+2)nd frame in FIG. 16, or for the portion astride the UV portion and the V portion, the UV portion encodes and decodes only data of ±80 samples (a sum total of 160 samples is equal to one frame interval). The result is that windowing is carried out beyond a center point CN between neighboring frames on the V-side, while it is carried out as far as the center point CN on the UV side, for overlapping the junction portions, as shown in FIG. 17. The reverse procedure is used for the UV to V transient portion. The windowing on the V-side may also be as shown by a broken line in FIG. 17.

The noise synthesis and the noise addition at the voiced (V) portion is now further explained. These operations are performed by the noise synthesis circuit 216, weighted overlap-and-add circuit 217 and by the adder 218 of FIG. 4 by adding to the voiced portion of the LPC residual signal the noise which takes into account the following parameters in connection with the excitation of the voiced portion as the LPC synthesis filter input. That is, the above parameters may be enumerated by the pitch lag Pch, spectral amplitude Am[i] of the voiced sound, maximum spectral amplitude in a frame Amax and the residual signal level Lev. The pitch lag Pch is the number of samples in a pitch period for a pre-set sampling frequency fs, such as fs=8 kHz, while i in the spectral amplitude Am[i] is an integer such that $0 \leqq i \leqq I$ for the number of harmonics in the band of fs/2 equal to I=Pch/2.

Figure 18:
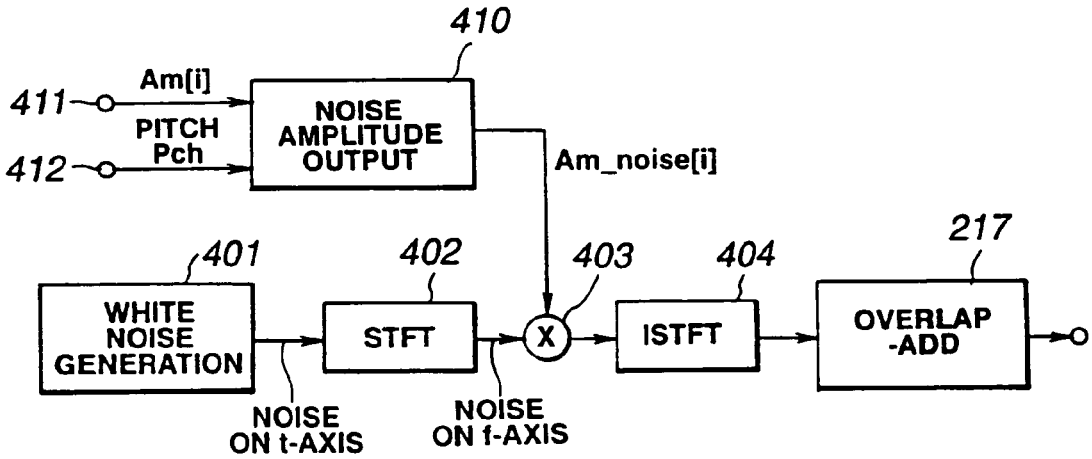
FIG. 18 illustrates the operation of noise addition at the time of synthesis of the voiced sound.

The processing by this noise synthesis circuit 216 is carried out in much the same way as in synthesis of the unvoiced sound by, for example, multi-band encoding (MBE). FIG. 18 illustrates a specified embodiment of the noise synthesis circuit 216.

That is, referring to FIG. 18, a white noise generator 401 outputs the Gaussian noise which is then processed with the short-term Fourier transform (STFT) by an STFT processor 402 to produce a power spectrum of the noise on the frequency axis. The Gaussian noise is the time-domain white noise signal waveform windowed by an appropriate windowing function, such as a Hamming window, having a pre-set length, such as 256 samples. The power spectrum from the STFT processor 402 is sent for amplitude processing to a multiplier 403 so as to be multiplied with an output of the noise amplitude control circuit 410. An output of the amplifier 403 is sent to an inverse STFT (ISTFT) processor 404 where it is ISTFTed using the phase of the original white noise as the phase for conversion into a time-domain signal. An output of the ISTFT processor 404 is sent to a weighted overlap-add circuit 217.

In the embodiment of FIG. 18, the time-domain noise is generated from the white noise generator 401 and processed with orthogonal transform, such as STFT, for producing the frequency-domain noise. Alternatively, the frequency-domain noise may also be generated directly by the noise generator. By directly generating the frequency-domain noise, orthogonal transform processing operations such as for STFT or ISTFT, may be eliminated.

Specifically, a method of generating random numbers in a range of ±x and handling the generated random numbers as real and imaginary parts of the FFT spectrum, or a method of generating positive random numbers ranging from 0 to a maximum number (max) for handling them as the amplitude of the FFT spectrum and generating random numbers ranging from $-\pi$ to $+\pi$ and handling these random numbers as the phase of the FFT spectrum, may be employed.

This renders it possible to eliminate the STFT processor 402 of FIG. 18 to simplify the structure or to reduce the processing volume.

Figure 19:
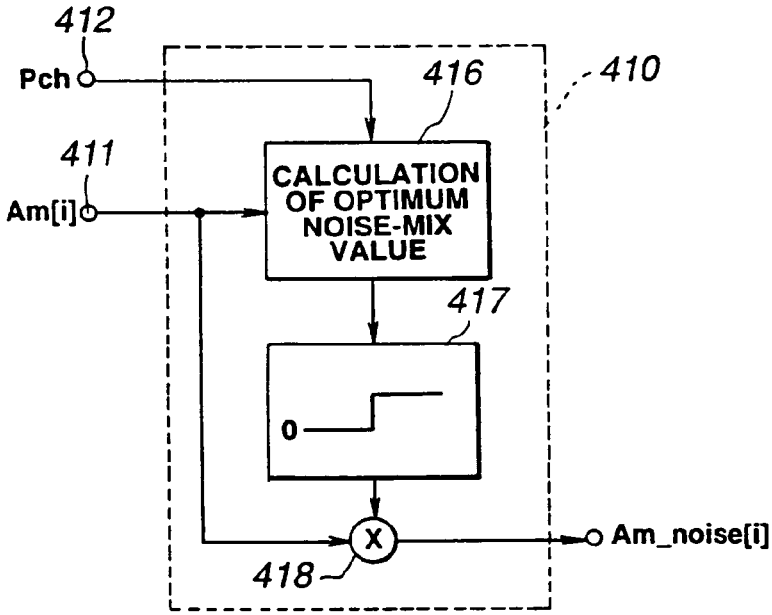
FIG. 19 illustrates an example of the amplitude of the noise added at the time of synthesis of the voiced sound.

The noise amplitude control circuit 410 has a basic structure shown for example in FIG. 19 and finds the synthesized noise amplitude Am-noise[i] by controlling the multiplication coefficient at the multiplier 403 based on the spectral amplitude Am[i] of the voiced (V) sound supplied via a terminal 411 from the quantizer 212 of the spectral envelope of FIG. 4. That is, in FIG. 19, an output of an optimum noise-mix value calculation circuit 416, to which are entered the spectral amplitude Am[i] and the pitch lag Pch, is weighted by a noise weighting circuit 417, and the resulting output is sent to a multiplier 418 so as to be multiplied with a spectral amplitude Am[i] to produce a noise amplitude Am-noise[i]. As a first specified embodiment for noise synthesis and addition, a case in which the noise amplitude Am-noise[i] becomes a function of two of the above four parameters, namely the pitch lag Pch and the spectral amplitude Am[i], is now explained.

Among these functions $f_1$(Pch, Am[i]) are:

$f_1$(Pch, Am[i])=0 where 0≦i≦Noise_b×I), $f_1$(Pch, Am[i])=Am[i]×noise-mix where Noise-b×I≦i≦I, and noise-mix=K×Pch/2.0.

It is noted that the maximum value of noise-max is noise-mix-max at which it is clipped. As an example, K=0.02, noise-mix-max=0.3 and Noise-b=0.7, where Noise-b is a constant which determines to which portion of the entire band this noise is to be added. In the present embodiment, the noise is added in a frequency range higher than 70%-position, that is, if fs=8 kHz, the noise is added in a range from 4000×0.7=2800 kHz as far as 4000 kHz.

As a second specified embodiment for noise synthesis and addition, in which the noise amplitude Am-noise[i] is a function $f_2$(Pch, Am[i], Amax) of three of the four parameters, namely the pitch lag Pch, spectral amplitude Am[i], and the maximum spectral amplitude Amax, is explained.

Among these functions $f_2$(Pch, Am[i], Amax) are:

$f_2$(Pch, Am[i], Amax)=0, where 0≦i≦Noise-b×I), $f_1$(Pch, Am[i], Amax)=Am[i]×noise-mix where Noise-b×I≦i≦I, and noise-mix=K×Pch/2.0.

It is noted that the maximum value of noise-mix is noise-mix-max and, as an example, K=0.02, noise-mix-max=0.3 and Noise-b=0.7.

If Am[i]×noise-mix>A max×C×noise-mix, $f_2$(Pch, Am[i], Amax)=Amax×C×noise-mix, where the constant C is set to 0.3 (C=0.3). Since the level can be prohibited by this conditional equation from being excessively large, the above values of K and noise-mix-max can be increased further and the noise level can be increased further if the high-range level is higher.

As a third specified embodiment of the noise synthesis and addition, the above noise amplitude Am-noise[i] may be a function of all of the above four parameters, that is $f_3$(Pch, Am[i], Amax, Lev).

Specified examples of the function $f_3$(Pch, Am[i], Am[max], Lev) are basically similar to those of the above function $f_2$(Pch, Am[i], Amax). The residual signal level Lev is the root mean square (RMS) of the spectral amplitudes Am[i] or the signal level as measured on the time axis. The difference from the second specified embodiment is that the values of K and noise-mix-max are set so as to be functions of Lev. That is, if Lev is smaller or larger, the values of K, and noise-mix-max are set to larger and smaller values, respectively. Alternatively, the value of Lev may be set so as to be inversely proportionate to the values of K and noise-nix-max.

The post-filters 238*v*, 238*u* will now be further explained.

Figure 20:
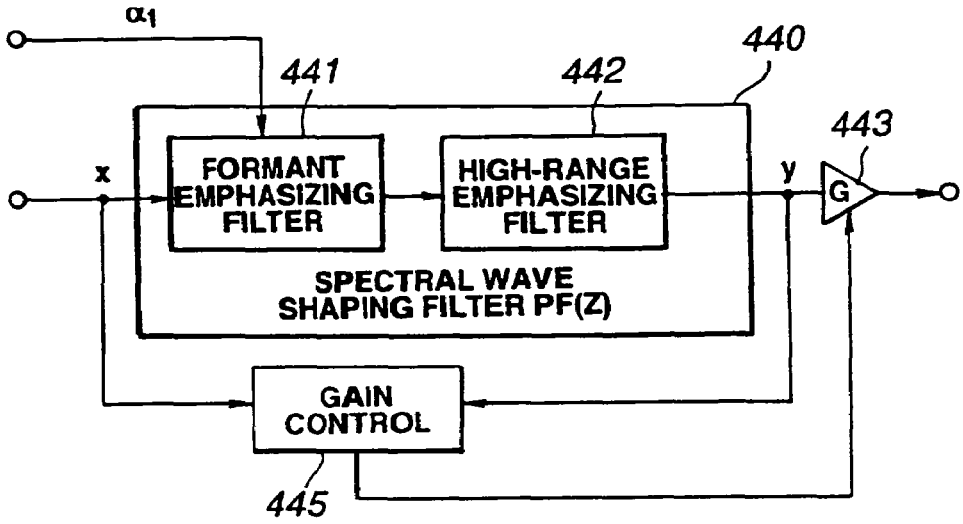
FIG. 20 illustrates an example of a post-filter.

FIG. 20 shows a post-filter that may be used as post-filters 238*u*, 238*v* in the embodiment of FIG. 4. A spectrum shaping filter 440, as an essential portion of the post-filter, is made up of a formant emphasizing filter 441 and a high-range emphasizing filter 442. An output of the spectrum shaping filter 440 is sent to a gain adjustment circuit 443 adapted for correcting gain changes caused by spectrum shaping. The gain adjustment circuit 443 has its gain G determined by a gain control circuit 445 by comparing an input x to an output y of the spectrum shaping filter 440 for calculating gain changes for calculating correction values.

If the coefficients of the denominators Hv(z) and Huv(z) of the LPC synthesis filter, that is, α-parameters, are expressed as $\alpha_i$, the characteristics PF(z) of the spectrum shaping filter 440 may be expressed by:

$$PF(z) = \frac{\sum_{i=0}^{P} \alpha_i \beta^i z^{-i}}{\sum_{i=0}^{P} \alpha_i \gamma^i z^i}(1 - kz^{-1})$$

The fractional portion of this equation represents characteristics of the formant emphasizing filter, while the portion $(1-kz^{-1})$ represents characteristics of a high-range emphasizing filter. β, γ and k are constants, such that, for example, β=0.6, γ=0.8 and k 0.3.

The gain of the gain adjustment circuit 443 is given by:

$$G = \sqrt{\frac{\sum_{i=0}^{159} x^2(i)}{\sum_{i=0}^{159} y^2(i)}}$$

In the above equation, x(i) and y(i) represent an input and an output of the spectrum shaping filter 440, respectively.

It is noted that, while the coefficient updating period of the spectrum shaping filter 440 is 20 samples or 2.5 msec as is the updating period for the α-parameter which is the coefficient of the LPC synthesis filter, the updating period of the gain G of the gain adjustment circuit 443 is 160 samples or 20 msec.

By setting the coefficient updating period of the spectrum shaping filter 443 so as to be longer than that of the coefficient of the spectrum shaping filter 440 as the post-filter, it becomes possible to prevent ill effects otherwise caused by gain adjustment fluctuations.

Figure 21:
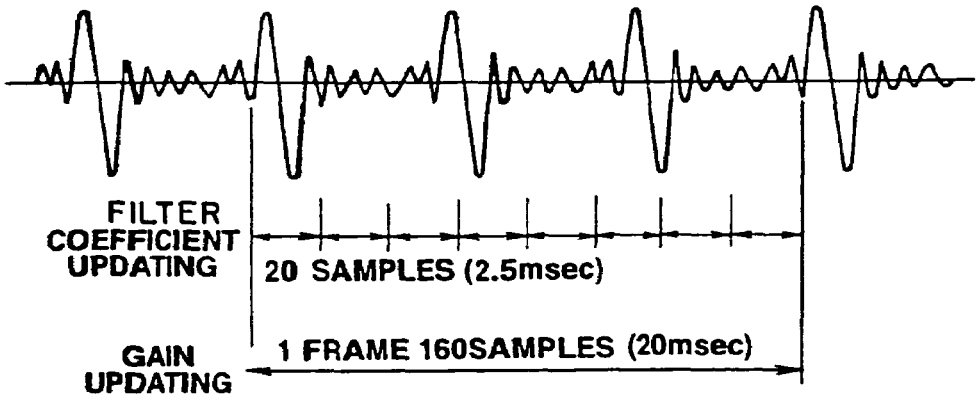
FIG. 21 illustrates the gain updating period and the filter coefficient updating period of a post-filter.

That is, in a generic post filter, the coefficient updating period of the spectrum shaping filter is set so as to be equal to the gain updating period and, if the gain updating period is selected to be 20 samples and 2.5 msec, variations in the gain values are caused even in one pitch period, thus producing a click noise. In the present embodiment, by setting the gain switching period to be longer, for example, equal to one frame or 160 samples or 20 msec as shown in FIG. 21, abrupt gain value changes may be prohibited from occurring. Conversely, if the updating period of the spectrum shaping filter coefficients is 160 samples or 20 msec, no smooth changes in filter characteristics can be produced, thus producing ill effects in the synthesized waveform. However, by setting the filter coefficient updating period to shorter values of 20 samples or 2.5 msec, it becomes possible to realize more effective post-filtering.

By way of gain junction processing between neighboring frames, the filter coefficient and the gain of the previous frame and those of the current frame are multiplied by triangular windows of $$W(i)=i/20\ (0\leqq i\leqq 20)\text{ and}$$

Figure 22:
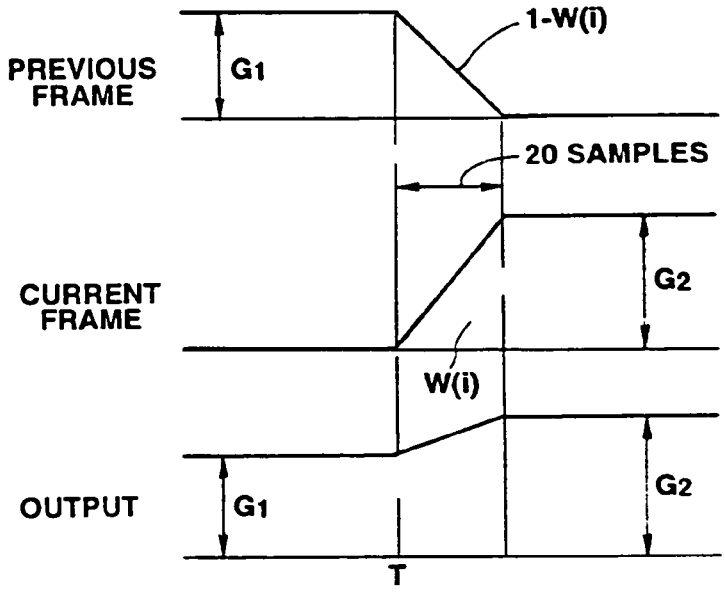
FIG. 22 illustrates processing for a junction portion at the frame boundary of the gain and filter coefficients of a post-filter.

$1-W(i)$ where $0\leqq i\leqq 20$ for fade-in and fade-out and the resulting products are summed together. FIG. 22 shows how the gain $G_1$ of the previous frame merges to the gain $G_1$ of the current frame. Specifically, the proportion of using the gain and the filter coefficients of the previous frame is decreased gradually, while that of using the gain and the filter coefficients of the current filter is increased gradually. The inner states of the filter for the current frame and that for the previous frame at a time point T of FIG. 22 are started from the same states, that is from the final states of the previous frame.

Figure 23:
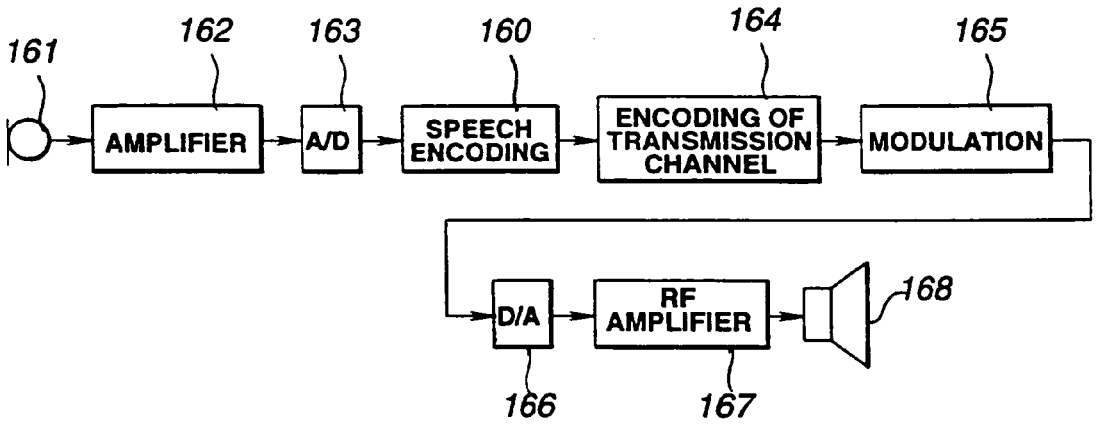
FIG. 23 is a block diagram showing the transmitting side of a portable terminal employing a speech signal encoder according to the present invention.
Figure 24:
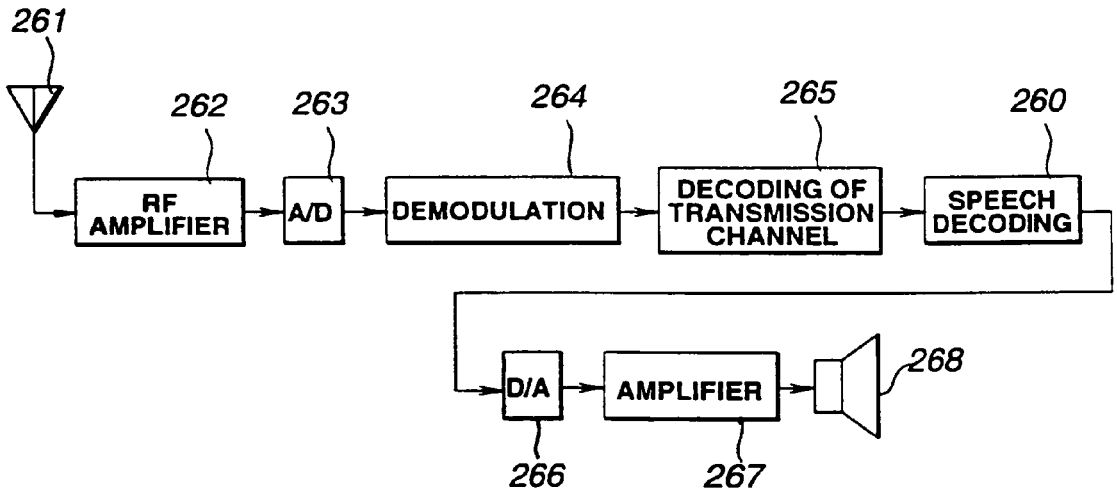
FIG. 24 is a block diagram showing the receiving side of a portable terminal employing a speech signal decoder according to the present invention.

The above-described signal encoding and signal decoding apparatus may be used as a speech codebook employed in, for example, a portable communication terminal or a portable telephone set shown in FIGS. 23 and 24.

FIG. 23 shows a transmitting side of a portable terminal employing a speech encoding unit 160 configured as shown in FIGS. 1 and 3. The speech signals collected by a microphone 161 are amplified by an amplifier 162 and converted by an analog/digital (A/D) converter 163 into digital signals which are sent to the speech encoding unit 160 configured as shown in FIGS. 1 and 3. The digital signals from the A/D converter 163 are supplied to the input terminal 101. The speech encoding unit 160 performs encoding as explained in connection with FIGS. 1 and 3. Output signals of output terminals of FIGS. 1 and 3 are sent as output signals of the speech encoding unit 160 to a transmission channel encoding unit 164 which then performs channel coding on the supplied signals. Output signals of the transmission channel encoding unit 164 are sent to a modulation circuit 165 for modulation and thence supplied to an antenna 168 via a digital/analog (D/A) converter 166 and an RF amplifier 167.

FIG. 24 shows a reception side of the portable terminal employing a speech decoding unit 260 configured as shown in FIG. 4. The speech signals received by the antenna 261 of FIG. 24 are amplified an RF amplifier 262 and sent via an analog/digital (A/D) converter 263 to a demodulation circuit 264, from which demodulated signals are sent to a transmission channel decoding unit 265. An output signal of the decoding unit 265 is supplied to a speech decoding unit 260 configured as shown in FIGS. 2 and 4. The speech decoding unit 260 decodes the signals in a manner as explained in connection with FIGS. 2 and 4. An output signal at an output terminal 201 of FIGS. 2 and 4 is sent as a signal of the speech decoding unit 260 to a digital/analog (D/A) converter 266. An analog speech signal from the D/A converter 266 is sent to a speaker 268 through an amplifier 267.

The present invention is not limited to the above-described embodiments. For example, the construction of the speech analysis side (encoder) of FIGS. 1 and 3 or the speech synthesis side (decoder) of FIGS. 2 and 4, described above as hardware, may be realized by a software program using, for example, a digital signal processor (DSP). The synthesis filters 236, 237 or the post-filters 238*v*, 238*u* on the decoding side may be designed, respectively, as a single LPC synthesis filter or a single post-filter without separation into those for the voiced speech or the unvoiced speech. The present invention is also not limited to transmission or recording/reproduction and may be applied to a variety of usages such as pitch conversion, speed conversion, synthesis of computerized speech, or noise suppression.

What is claimed is:

1. A speech encoding method in which an input speech signal is divided on a time axis in terms of pre-set encoding units and encoded in terms of the pre-set encoding units, comprising the steps of:

detecting a voiced/unvoiced sound state of the input speech signal and classifying the input speech signal into voiced portions and unvoiced portions;

finding short-term prediction residuals of the voiced portions of the input speech signal;

encoding the short-term prediction residuals of the voiced portions of the input speech signal by sinusoidal analytic encoding; and encoding the unvoiced portions of the input speech signal by waveform encoding.

2. The speech encoding method as claimed in claim 1, wherein harmonic encoding is employed as the sinusoidal analytic encoding.

3. The speech encoding method as claimed in claim 1, wherein a voiced/unvoiced sound state of each of a plurality of portions of the input speech signal is detected for classifying each of the plurality of portions of the input speech signal into one of a voiced mode and an unvoiced mode, and wherein the portions of the input speech signal classified to be in the voiced mode are encoded by said sinusoidal analytic encoding while the portions of the input speech signal classified to be in the unvoiced mode are processed with said waveform encoding, said waveform encoding including vector quantization of the time-domain waveform by a closed loop search for the optimum vector using an analysis by synthesis method.

4. The speech encoding method as claimed in claim 1, wherein one of a perceptually weighted vector quantization process and matrix quantization process is used for quantization of the sinusoidal analysis encoding parameters of the short-term prediction residuals.

5. The speech encoding method as claimed in claim 4, wherein weights are calculated at the time of performing one of said perceptually weighted matrix quantization process and vector quantization process based on the results of orthogonal transform of parameters derived from an impulse response of a weight transfer function.

6. A speech encoding apparatus in which an input speech signal is divided on a time axis in terms of pre-set encoding units and encoded in terms of the pre-set encoding units, comprising:

means for detecting a voiced/unvoiced sound state of the input speech signal and classifying the input speech signal into voiced portions and unvoiced portions;

means for finding short-term prediction residuals of voiced portions of the input speech signal;

means for encoding the short-term prediction residuals of voiced portions of the input speech signal by sinusoidal analytic encoding; and means for encoding unvoiced portions of the input speech signal by waveform encoding.

7. The speech encoding apparatus as claimed in claim 6, wherein harmonic encoding is employed as the sinusoidal analytic encoding.

8. The speech encoding apparatus as claimed in claim 6, further comprising:

means for discriminating if the input speech signal is voiced speech or unvoiced speech and for generating a voiced/unvoiced mode signal; and switch means responsive to the voice/unvoiced mode signal for outputting an encoded signal provided by the means for encoding the short-term prediction residuals when the voiced/unvoiced mode signal indicates that the input speech is voiced speech and for outputting an encoded signal produced by the means for encoding the input speech signal by waveform encoding when the voiced/unvoiced mode signal indicates that the input speech is unvoiced speech;

wherein said waveform encoding means performs code excited linear predictive coding doing vector quantization by closed loop search of an optimum vector using an analysis by synthesis method.

9. The speech encoding apparatus as claimed in claim 6, wherein said sinusoidal analytic encoding means uses one of a perceptually weighted vector quantization process and matrix quantization process for quantizing the sinusoidal analytic encoding parameters of said short-term prediction residuals.

10. The speech encoding apparatus as claimed in claim 6, wherein said sinusoidal analytic encoding means calculates a weight at the time of performance of one of said perceptually weighted matrix quantization process and vector quantization process on the basis of the results of orthogonal transform of parameters derived from an impulse response of a weight transfer function.

11. A speech decoding method for decoding an encoded speech signal obtained by encoding a voiced portion of an input speech signal with first encoding comprising sinusoidal analytic encoding and by encoding an unvoiced portion of the input speech signal with second encoding employing short-term prediction residuals, comprising the steps of:

finding first short-term prediction residuals for the voiced speech portion of the encoded speech signal by sinusoidal synthesis;

finding second short-term prediction residuals for the unvoiced speech portion of the encoded speech signal; and employing predictive synthetic filtering for synthesizing first and second time-axis waveforms based on the first and second short-term prediction residuals of the voiced and unvoiced speech portions, respectively.

12. The speech decoding method as claimed in claim 11, further comprising a first post-filtering step of post-filtering the first time-axis waveform of the voiced portion, and a second post-filtering step of post-filtering the second time-axis waveform of the unvoiced portion.

13. The speech decoding method as claimed in claim 12, further comprising the step of combining the first and second post-filtered time-axis waveforms of the voiced and unvoiced portions, respectively, to synthesize a third time-axis waveform.

14. The speech decoding method as claimed in claim 11, wherein one of a perceptually weighted vector quantization process and matrix quantization process is used for quantizing a sinusoidal synthetic parameter of said short-term prediction residuals.

15. A speech decoding apparatus for decoding an encoded speech signal obtained by encoding voiced portions of an input speech signal with a first encoding and by encoding unvoiced portions of the input speech signal with a second encoding, comprising:

means for finding short-term prediction residuals for the voiced portions of the input speech signal by sinusoidal analytic encoding;

means for finding short-term prediction residuals for the unvoiced portions of said encoded speech signal; and predictive synthetic filtering means for synthesizing a first time-axis waveform based on said short-term prediction residuals of the voiced speech portions and for synthesizing a second time-axis waveform based on the short-term prediction residuals of the unvoiced speech portions.

16. The speech decoding apparatus as claimed in claim 15, wherein said predictive synthetic filtering means further comprises:

first predictive filtering means for synthesizing said first time-axis waveform of the voiced portion based on the short-term prediction residuals of the voiced speech portion, and second predictive filtering means for synthesizing said second time-axis waveform of the unvoiced portion based on the short-term prediction residuals of the unvoiced speech portion.

17. A speech decoding method for decoding an encoded speech signal obtained by finding short-term prediction residuals of an input speech signal and encoding resulting short-term prediction residuals with sinusoidal analytic encoding, comprising the steps of:

finding said short-term prediction residuals of said encoded speech signal by sinusoidal synthesis;

adding noise controlled in amplitude based on said encoded speech signal to said short-term prediction residuals found by said sinusoidal synthesis; and performing predictive synthetic filtering by synthesizing a time-domain waveform based on said short-term prediction residuals found by said sinusoidal synthesis added to said noise.

18. The speech decoding method as claimed in claim 17, wherein said step of adding said noise adds said noise controlled on a basis of pitch and spectral envelope obtained from said encoded speech signal.

19. The speech decoding method as claimed in claim 17, wherein said noise added in said step of adding has an upper value which is limited to a pre-set value.

20. The speech decoding method as claimed in claim 17, wherein said sinusoidal analytic encoding is performed on short-term prediction residuals of a voiced portion of said input speech signal and wherein vector quantization of said time-domain waveform by a closed-loop search of an optimum vector is performed on an unvoiced portion of said input speech signal by an analysis by synthesis method.

21. A speech decoding apparatus for decoding an encoded speech signal obtained by finding short-term prediction residuals of an input speech signal and encoding said resulting short-term prediction residuals with sinusoidal analytic encoding, comprising:

sinusoidal synthesis means for finding said short-term prediction residuals of said encoded speech signal by sinusoidal synthesis;

noise addition means for adding noise controlled in amplitude based on said encoded speech signal to said short-term prediction residuals; and predictive synthetic filtering means for synthesizing a time-domain waveform based on said short-term prediction residuals found by said sinusoidal synthesis means added to said noise.

22. The speech decoding apparatus as claimed in claim 21, wherein said noise addition means adds said noise controlled on a basis of pitch and spectral envelope obtained from said encoded speech signal.

23. The speech decoding apparatus as claimed in claim 21, wherein said noise added by said noise addition means has an upper value which is limited to a pre-set value.

24. The speech decoding apparatus as claimed in claim 21, wherein said sinusoidal analytic encoding is performed on short-term prediction residuals of a voiced portion of said input speech signal and wherein vector quantization of said time-domain waveform by a closed-loop search of an optimum vector is performed on an unvoiced portion of said input speech signal by an analysis by synthesis method.

25. A method for encoding an audible signal, comprising the steps of:

converting parameters derived from the input audible signal into a frequency-domain signal; and performing weighted vector quantization of said parameters, the weight of said weighted vector quantization being calculated based on results of an orthogonal transform of parameters derived from an impulse response of a weight transfer function.

26. The method for encoding an audible signal as claimed in claim 25, wherein said orthogonal transform is a fast Fourier transform, wherein a real part of a coefficient resulting from the fast Fourier transform is expressed as re, an imaginary part of the coefficient resulting from the fast Fourier transform is expressed as im, and wherein one of the group consisting of (re, im) itself, $re^2+im^2$, and $(re^2+im^2)^{1/2}$, as interpolated, is used as said weight.

27. A portable radio terminal apparatus comprising:

amplifier means for amplifying an input speech signal;

A/D conversion means for performing analog to digital conversion of an output signal from said amplifier means;

speech encoding means for speech-encoding an output signal from said A/D conversion means;

transmission path encoding means for channel coding an output signal from said speech encoding means;

modulation means for modulating an output signal from said transmission path encoding means;

D/A conversion means for performing digital to analog conversion of an output signal from said modulation means; and amplifier means for amplifying an output signal from said D/A conversion means and supplying the resulting amplified signal to an antenna;

wherein said speech encoding means comprises:

means for detecting a voiced/unvoiced sound state of the input speech signal and classifying the input speech signal into voiced portions and unvoiced portions;

predictive encoding means for finding short-term prediction residuals of voiced portions of the input speech signal;

sinusoidal analytic encoding means for encoding the short-term prediction residuals of voiced portions of the input speech signal by sinusoidal analytic encoding; and waveform encoding means for waveform encoding of unvoiced portions of the input speech signal.

28. A portable radio terminal apparatus comprising:

amplifier means for amplifying a received signal;

A/D conversion means for performing analog to digital conversion of an output signal from said amplifier means;

demodulating means for demodulating an output signal from said A/D conversion means;

transmission path decoding means for channel decoding an output signal from said demodulating means;

speech decoding means for speech-decoding an output signal from said transmission path decoding means; and D/A conversion means for performing digital to analog conversion of an output signal from said demodulating means;

wherein said speech decoding means comprises:

sinusoidal synthesis means for finding short-term prediction residuals of said encoded speech signal by sinusoidal synthesis;

noise addition means for adding noise controlled in amplitude based on said encoded speech signal to said short-term prediction residuals; and a predictive synthetic filter for synthesizing a time-domain waveform based on the short-term prediction residuals added to the noise.

* * * * *